US008430400B2

(12) United States Patent
Lewalski et al.

(10) Patent No.: US 8,430,400 B2
(45) Date of Patent: Apr. 30, 2013

(54) SYSTEM AND METHOD FOR ROTATING SHEETS

(75) Inventors: Steven P. Lewalski, Melrose, MA (US); James P. Zamanakos, Dracut, MA (US); Bruce J. Taylor, Manchester, NH (US); Sean Stewart, Brighton, MA (US)

(73) Assignee: Lasermax Roll Systems, Inc., Billerica, MA (US)

( * ) Notice: Subject to any disclaimer, the term of this patent is extended or adjusted under 35 U.S.C. 154(b) by 0 days.

(21) Appl. No.: 13/281,666

(22) Filed: Oct. 26, 2011

(65) Prior Publication Data

US 2012/0080837 A1 Apr. 5, 2012

Related U.S. Application Data

(63) Continuation of application No. 12/249,857, filed on Oct. 10, 2008, now Pat. No. 8,061,709.

(51) Int. Cl.
*B65H 5/00* (2006.01)

(52) U.S. Cl.
USPC ..... 271/225; 271/185; 271/273

(58) Field of Classification Search ..... 271/225, 271/273, 274, 184–186
See application file for complete search history.

(56) References Cited

U.S. PATENT DOCUMENTS

| | | | |
|---|---|---|---|
| 5,130,724 | A | 7/1992 | Crowley |
| 5,692,746 | A | 12/1997 | Herrick, Jr. |
| 5,751,298 | A | 5/1998 | Crowley |
| 5,762,431 | A | 6/1998 | Pawelka et al. |
| 5,818,470 | A | 10/1998 | Crowley |
| 6,168,153 | B1 | 1/2001 | Richards et al. |
| 2008/0048386 | A1 | 2/2008 | Smith |

FOREIGN PATENT DOCUMENTS

| | | | |
|---|---|---|---|
| DE | 2916828 | A1 | 11/1980 |
| EP | 0587531 | A2 | 3/1994 |
| EP | 1624346 | A1 | 2/2006 |
| JP | 05301659 | A | 11/1993 |

*Primary Examiner* — Michael McCullough
(74) *Attorney, Agent, or Firm* — Loginov & Associates, PLLC; William A. Loginov

(57) ABSTRACT

A system and method for rotating sheets receiving cut sheets from a source and providing them to a utilization device. The rotator continually engages sheets with at least one drive component throughout the transport and rotation process. The rotator includes a transport mechanism having a plurality of nip roller pairs along the length of a feed table. The nip rollers (nips) can be selectively engaged with, and disengaged from, the driven rollers using discrete actuators. This allows for feed velocity differentials when entering and exiting the rotator feed table, and also for clearance during sheet rotation. A rotator disk assembly is centered on the table between, and comprises a driven rotator disk and an overriding, freely rotating pressure disk. When sheets enter or pass through the rotator section, the pressure disk is raised to provide a clearance for sheets to pass.

9 Claims, 34 Drawing Sheets

SYSTEM AND METHOD FOR ROTATING SHEETS

RELATED APPLICATION

This application is a continuation of U.S. patent application Ser. No. 12/249,857, filed Oct. 10, 2008, entitled SYSTEM AND METHOD FOR ROTATING SHEETS, the entire disclosure of which is herein incorporated by reference.

FIELD OF THE INVENTION

This invention relates to sheet-feeding and handling devices and more particularly to devices for rotating cut sheets.

BACKGROUND OF THE INVENTION

Electronic publishing and print-on-demand applications have become increasingly popular in recent years. In such operations, a high-speed electronic printer, also commonly termed a "laser printer" is employed to produce printed pages that are thereafter bound into books of appropriate size and shape. Contemporary electronic printers, and the peripheral sheet-utilization devices that accompany them, are capable of providing duplex-printed (e.g. two-sided) sheets that can be folded-over and interleaved into a bound book, or otherwise cut and stacked to form a bound book. Where large-size sheets are employed (for example 14½-inch by 22½-inch sheets) a plurality of pages can be printed on a single sheet. The sheet is then subsequently cut and/or or folded into a completed book in the appropriate page order.

It is often desirable to feed individual sheets, including large-scale sheets adapted for book folding, into a sheet-feed electronic printer. However, it is also desirable, for increased efficiency, to derive the individual sheets from a continuous roll of paper web. Thus, the web is initially fed from a driven roll stand to a downstream cutter, where sheets of the desired length are cut from a web of predetermined width. In some implementations, the web may be slit along its length to derive two or more narrower sheets as well. The individual sheets are then passed into electronic printer. One example of a sheet feeder, which passes individual sheets into a printer is shown and described in the U.S. Pat. No. 5,818,470, entitled SYSTEM AND METHOD FOR DIRECTLY FEEDING PAPER TO PRINTING DEVICES, by Crowley, and related patents thereto, the teachings of which are expressly incorporated herein by reference. This patent describes a technique for feeding sheets to a stack-feed port of a printer or other utilization device based upon the demand for sheets by the stack feeder of the device. However, contemporary printers/utilization devices often contain dedicated sheet feed port that issues a request signal to provide sheets from the cutter to the port.

One particular concern in the preparation and binding of books is the grain direction of the paper. When paper is produced, it defines a grain direction that typically corresponds to the direction which the paper flows through the paper making process. To achieve the highest quality for the finished book, the sheets should be printed with a uniform grain direction, and the finished book should provide all pages with a similar grain direction. Since the grain direction of the roll may differ from that desired for the folded pages, maybe appropriate to rotate the sheets prior to feeding them into the electronic printer. In the past, this is entailed stacking the cut sheets into a feed stack, rotating the feed stack and then feeding the rotated stack of sheets to the feed port of the electronic printer. Clearly, this is a slower and less efficient process that requires additional human effort and may be prone to mistakes.

There are many other reasons that the user may desire the ability to rotate sheets and directly feed such sheets to a printer or other utilization device without resorting to the creation of an intermediate feed stack. For example, the web may be more efficiently cut in one orientation, by preferably fed in an orthogonal orientation to the cut orientation.

Rotation of sheets for a high-volume, high-speed handling application "on-the-fly" from a cutter is a challenging problem. Each sheet must be positively rotated to a substantially orthogonal orientation from its cut orientation without error—otherwise a jam or misfeed will occur. Feed rates in excess of 125-200 sheets-per-minute may be required. However, the rotator should preferably enable the handling a wide range of sheet dimensions, and optionally disable the rotation functionality when not needed.

It is, thus, desirable to provide a sheet-feeding arrangement that includes a novel system and method for rotating sheets before they are fed from a web cutter to an electronic printer or other sheet-utilization device. This system and method should allow relatively large-sized sheets (for example, up to approximately 14½ by 22½ inches) to be fed reliably with the proper rotation so as to account for grain direction and other dimensional requirements. The system and method should accommodate a range of sheet sizes and dimensions with easy adjustability therebetween. Such a system and method should provide a device that is easy to service and affords long-term reliability.

SUMMARY OF THE INVENTION

This invention overcomes the disadvantages of the prior art by providing a system and method for rotating sheets (a sheet rotator) that receives cut sheets from a source and provides them on demand to a utilization device. The rotator ensures that the sheets it handles are continually engaged by at least one drive or rotation component to ensure proper alignment throughout the rotator's transport and rotation process. The rotator can handle sheets having a wide variety of dimensions without the need for adjustment of guides or other elements, and can rotate and output fed sheets at a rate that matches or exceeds the demand rate of a typical utilization device.

In an illustrative embodiment, the sheet source can comprise a continuous web and cutter that forms cut sheets form the web having a predetermined length and width, and that drives the cut sheets in a downstream direction. Alternatively the source can be a stack of precut sheets and a feeder therefor. The illustrative sheet rotator includes a downstream end in communication with the input port of a sheet utilization device. The sheet utilization device can be an electronic printer, adapted to receive sheets of a predetermined length and width. The rotator includes a transport mechanism having a plurality of nip roller pairs along its length, each roller pair being located at a predetermined downstream spacing with respect to an adjacent pair, and the rollers in each pair being spaced apart at a predetermined widthwise spacing. The spacing is such that a wide range of sheet sizes (widths and lengths) can be handled, and at least one nip roller pair is always in engagement with the sheet during downstream transport. The nip roller pairs are driven at a predetermined drive speed by one or more central drive motors. The driven rollers of the nip roller pairs are typically located in the feed table, passing through respective slots therethrough. The slots can include downwardly directed ramps on a downstream edge thereof that prevent a leading edge of each of the sheets from binding against a downstream edge of the each of the slots. The upstream-most slots can also include upwardly angled ramps on upstream ends thereof that prevent the incoming sheets from the cutter from binding upon the upstream-most set of rollers. Likewise, elected slots adjacent to the rotator disk assembly can include raised (domed) surfaces in the feed table adjacent to a side of each of the slots orthogonal to the downstream direction constructed and arranged to deflect an edge each of the sheets over an adjacent of the rollers as each of the sheets is rotated by the rotator disk assembly. The rollers are selectively engaged using overriding, freewheeling nip rollers located within a movable cover assembly. Notably, the nip rollers (nips) can be selectively engaged with, and disengaged from, the driven rollers using discrete actuators within the cover assembly. This allows for feed velocity differentials when entering and exiting the rotator feed table, and also for clearance during sheet rotation. A rotator disk assembly is centered on the table between opposing pairs of nip rollers. The rotator disk assembly comprises a driven rotator disk (operated by a servo or rotary solenoid for example) that resides in a well on the table surface and an overriding, freely rotating pressure disk that resides in the cover assembly and is selectively driven axially by an actuator into and out of pressurable engagement with the driven disk. When sheets enter or pass through the rotator section, the pressure disk is raised to provide a clearance for sheets to pass. Conversely, when sheets are driven into a centered location with respect to the rotator disk assembly for rotation thereof, the pressure disk is lowered into a pressurable engagement with the driven disk. Concurrently (slightly after disk engagement so as to maintain grip on the sheet), appropriate nips surrounding the rotator disk assembly are raised to provide sufficient clearance for the rotation operation by the disks. The sheet is rotated at least ninety degrees appropriate nips are then reengaged before the pressure disk is disengaged from the sheet. The rotated sheet is then driven downstream to the outfeed end of the feed table. At the downstream-most/outfeed end of the feed table, the sheet is then driven at an appropriate rate and time into the feed port of the utilization device. Nips adjacent to the output sheet may be disengaged to allow free operation of clutch-driven outfeed rollers to direct the sheet into the port at a utilization device feed rate. The pressure disk can consist of an axially moving upper housing and a pressure plate freely rotatable with respect to the upper housing and movable laterally within a predetermined range with respect to the upper housing so as to align an axis of rotation of the pressure disk and an axis of rotation of the driven disk with a common axis of rotation.

The arrangement of the rotator's drive and rotation components allow for the handling of a wide range of sheet sizes and dimensions. The handling of sheets can be characterized by a plurality (five in an illustrative embodiment) of modes of operation. The modes are each based upon the size of the sheet being driven into the rotator, and whether rotation is instructed. In response to an input sheet size and rotation/non-rotation instruction from, for example, a system console particular pairs of nips are raised or lowered for each feed cycle. Likewise, the rotator is engaged or disengaged. Depending upon the mode, the table accommodates as many as three sheets at a time (rotation or non-rotation of small sheets in respective first and second modes). The table accommodates two sheets thereon in the rotation or non-rotation of larger-but-rotatable sheets (third and fourth modes). The table illustratively transports a single sheet at a time with sheets that exceed a maximum rotation radius but remain within the allowable length and width dimensions of the system (fifth mode).

BRIEF DESCRIPTION OF THE DRAWINGS

The invention description below refers to the accompanying drawings, of which.

DETAILED DESCRIPTION

I. Sheet Rotator Overview and Components

Figure 1:
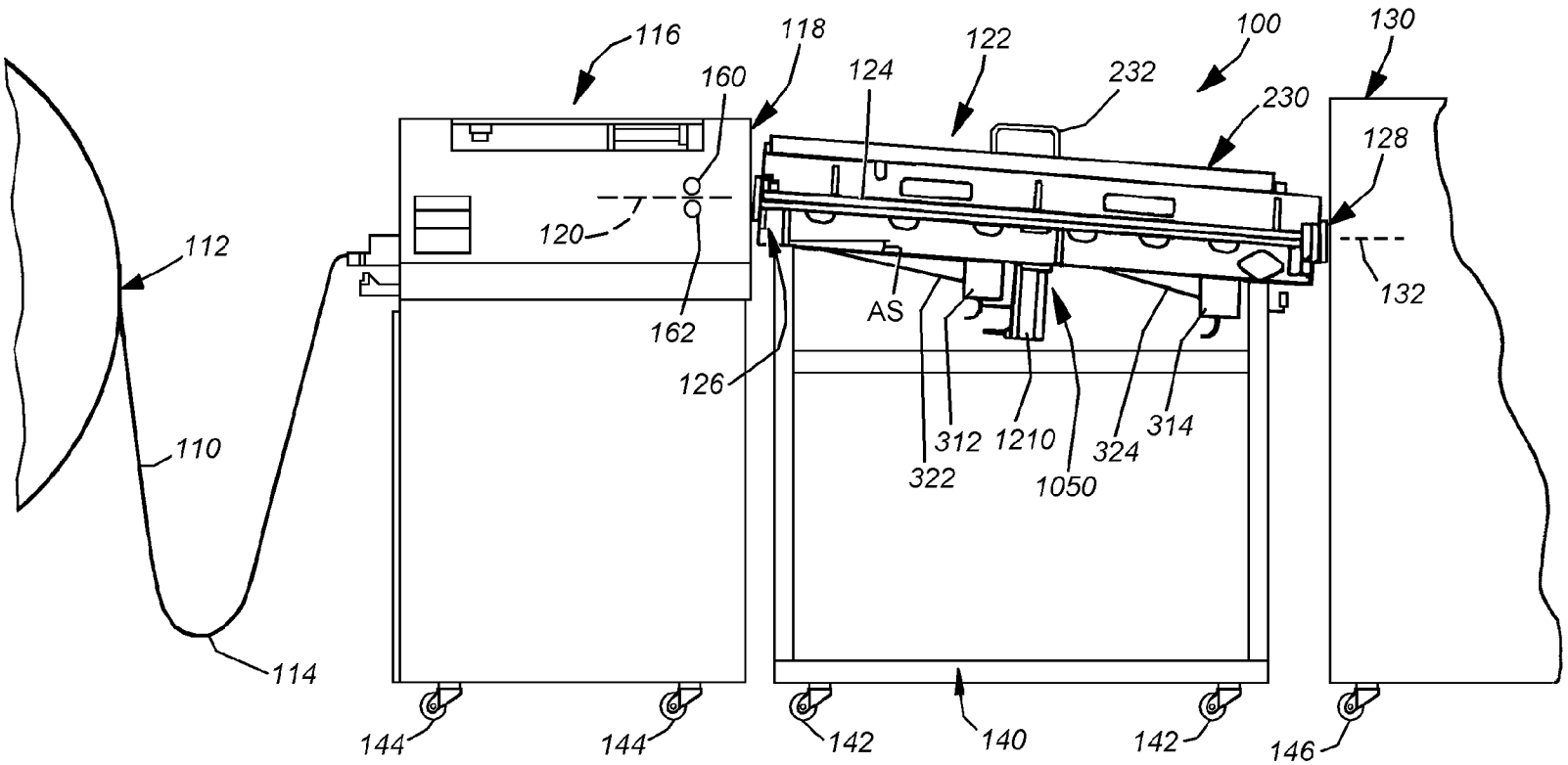
FIG. 1 is a side view of a sheet cutting, feeding, rotating and utilization system, including a sheet rotator according to an embodiment of this invention.

FIG. 1 details an overall view of an arrangement of sheet-feeding and rotating system 100 according to an illustrative embodiment of this invention. The arrangement 100 includes a source of continuous web 110 that can comprise a continuous driven roll 112 of conventional design. The roll is driven by a portable roll stand having, for example a peripheral drive member (no shown). The driven roll can include a sensing loop 114 that responds to draw of the web by a downstream cutter 116. The cutter 116 can also be of conventional design, such as a commercially available "guillotine" cutter which uses a reciprocating, sliding blade to separate the continuous web adjacent to the downstream end 118 of the cutter. An exemplary cutter is the Model 310 available from Bowe Systec AG of Germany. The cutter 118 includes a feed plane (dashed line 120) that is aligned with a corresponding surface of the feed table 124 of the sheet rotator 122 according to an illustrative embodiment of this invention. Roller pair 160, 162 is used to stabilize the sheet in the feed plane 120. The sheet rotator 122, and its structure and operation, will be described in full detail below. In general, it receives cut sheets from the cutter 116 and selectively rotates sheets at least 90 degrees (orthogonal to the original feed orientation). This rotation facilitates re-alignment of grain direction or other desirable goals. For example, the rotator allows a wide or narrow dimension of an input sheet to be switched before a sheet is passed from the rotator 122 into the sheet utilization device 130.

The utilization device 130 can be any device that allows for the feeding of cut sheets of predetermined dimensions. In this embodiment it includes a dedicated slot and feet surface 132 that is aligned for receiving sheets from the rotator 122 (or any other feeding device). Various arrangements in which sheets are fed to a utilization device, such as an electronic printer, are available from Lasermax Roll Systems of Burlington, Mass., under the trademark, DOCUSHEETER. Various aspects of the sheet feeding process are shown and described in, for example, commonly owned U.S. Pat. No. 5,818,470, entitled SYSTEM AND METHOD FOR DIRECTLY FEEDING PAPER TO PRINTING DEVICES, by Crowley, and related patents referenced therein, the teachings of which are expressly incorporated herein by reference. Earlier sheet feeding solutions, such as those of the incorporated patents, employ a variety of mechanisms to bypass conventional stack feeders. More contemporary utilization devices, such as the utilization device 130, employ purpose-built sheet feeding ports that draw-in sheets from an upstream feeding device, and request sheets from the upstream device at a predetermined rate by issuing print request signals that are recognized by the upstream device(s). The rotator 122 of this invention can be employed with a utilization device having either a dedicated sheet-feeding port, or a stack-feed bypass device.

With further reference to FIGS. 2-6, the rotator 122 of the illustrative embodiment of the rotator 122 is defined by the above-described feed surface 124, which, in this embodiment, includes an upstream or infeed end 126 and a downstream or outfeed end 128. The feed surface 124 is tilted at a slightly downward angle AS based upon a portable stand 140. The stand 140 includes casters or other mobility devices 142 that allow the rotator 122 to be portable, and thereby employed in a flexible printing environment. Other devices in the printing arrangement 100 may, likewise be portable. For example, the cutter 116 includes appropriate casters 144, as well as the utilization device 146 and the web source 112 (not shown). Casters or other portability elements can include appropriate locking mechanisms and/or retractable feet (not shown) in accordance with conventional designs. Likewise, the various joined-together components of the overall printing arrangement 100 can include appropriate alignment and locking devices that allow the components to be removably secured to each other. This prevents undesired separation of the devices as a result of vibrations and other forces during operation.

The rotator stand 140 is depicted as an open framework. In alternate embodiments, it can be fully or partially enclosed, and used to house various power, control and drive components as appropriate. The tilt angle AS of the feed surface 124 can be adjustable in various embodiments by use of automated or manual screw drives, linear actuators or other movement devices. The tilt angle AS allows sheets to pass from the cutter feed plane or surface 120 which is at a higher elevation with respect to a floor surface than the utilization device sheet feed-port surface 132, which is at a lower level. As shown, the underside of the rotator 122 includes the drive mechanism 310 according to the illustrative embodiment. The rotator's sheet transport drive mechanism 310 includes a pair of independently powered drive motors 312 and 314 that are linked by appropriate drive belts 322 and 324, respectively. The motors 312 and 314 can be servo motors, stepper motors or another motor that is controllable. The belt 322 drives an upstream set of drive roller pairs 330, 332 and 334. The downstream belt 324 drives a downstream set of drive roller pairs 336, 338 and 340. The belts can include a timing belt surface and the drive/driven pulleys can include interengaging teeth. Idlers 342, 344, 346 and 348 maintain a predetermined tension on the belt so that it securely engages the drive pulley of each drive roller pair without slippage.

The drive roller pairs 330, 332, 334, 336, 338 and 340 are mounted on bearings beneath the feed table surface 124 and extend through associated slots 610 in the feed surface. The rollers of each of the pairs can be include an outer surface constructed from a durable elastomeric compound (such as polyurethane or ethylene propylene diene M-class (EPDM) rubber) to provide gripping friction when engaging sheets. The rollers can be positioned slightly above or approximately level with, the plane of the feed table surface 124 to ensure proper engagement. As described further below, an additional downstream-most clutch-driven outfeed roller assembly 350 is provided at the downstream, outfeed end 128 of the rotator 122. In the illustrative embodiment, the lower, driven rollers include an EPDM surface, while the upper, freewheeling rollers are constructed from smooth-surfaced aluminum alloy. The surfaces of the upper and lower rollers are highly variable in alternate embodiments.

Figure 2:
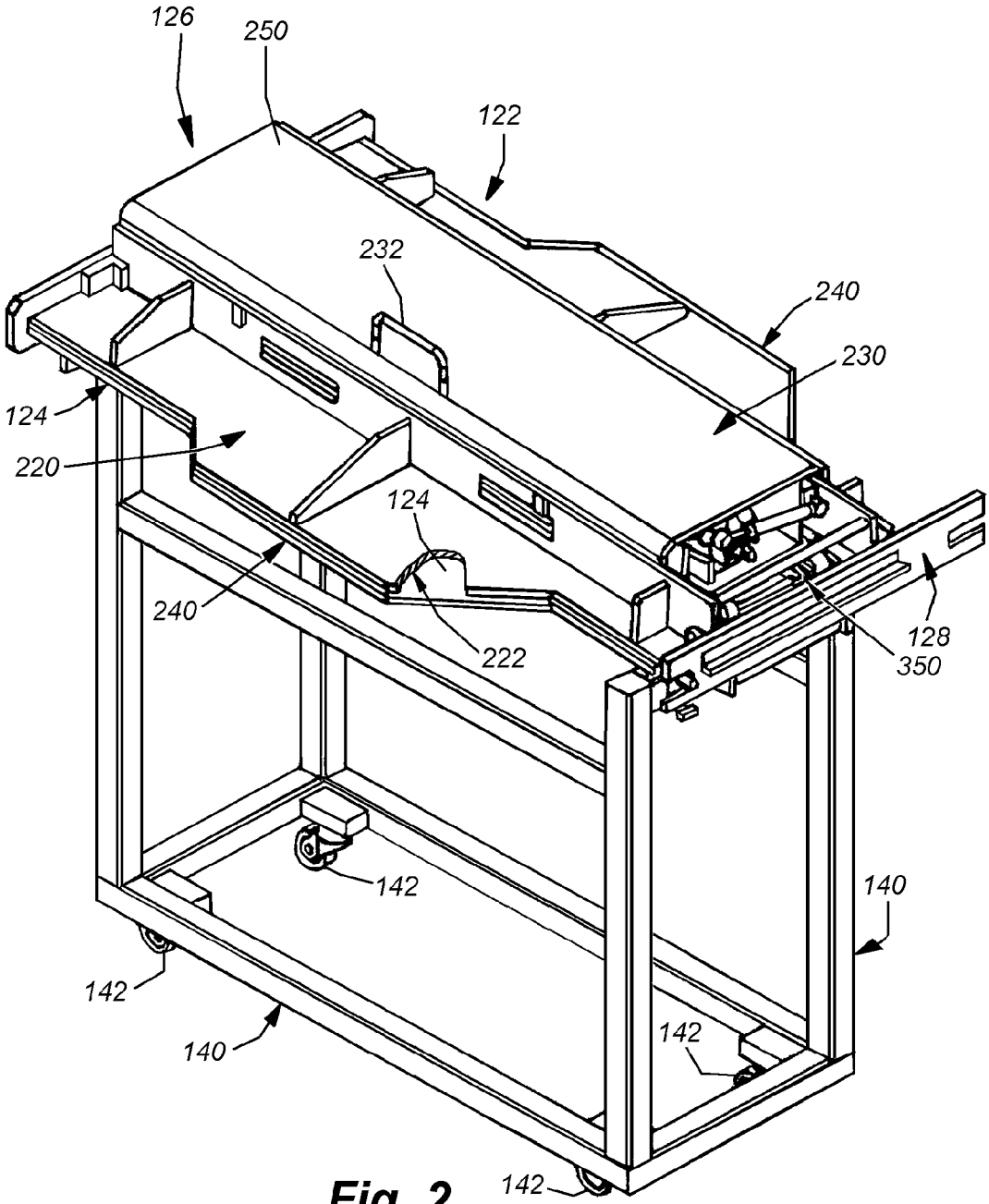
FIG. 2 is a more detailed perspective view of the sheet rotator of FIG. 1 with top covers closed.
Figure 3:
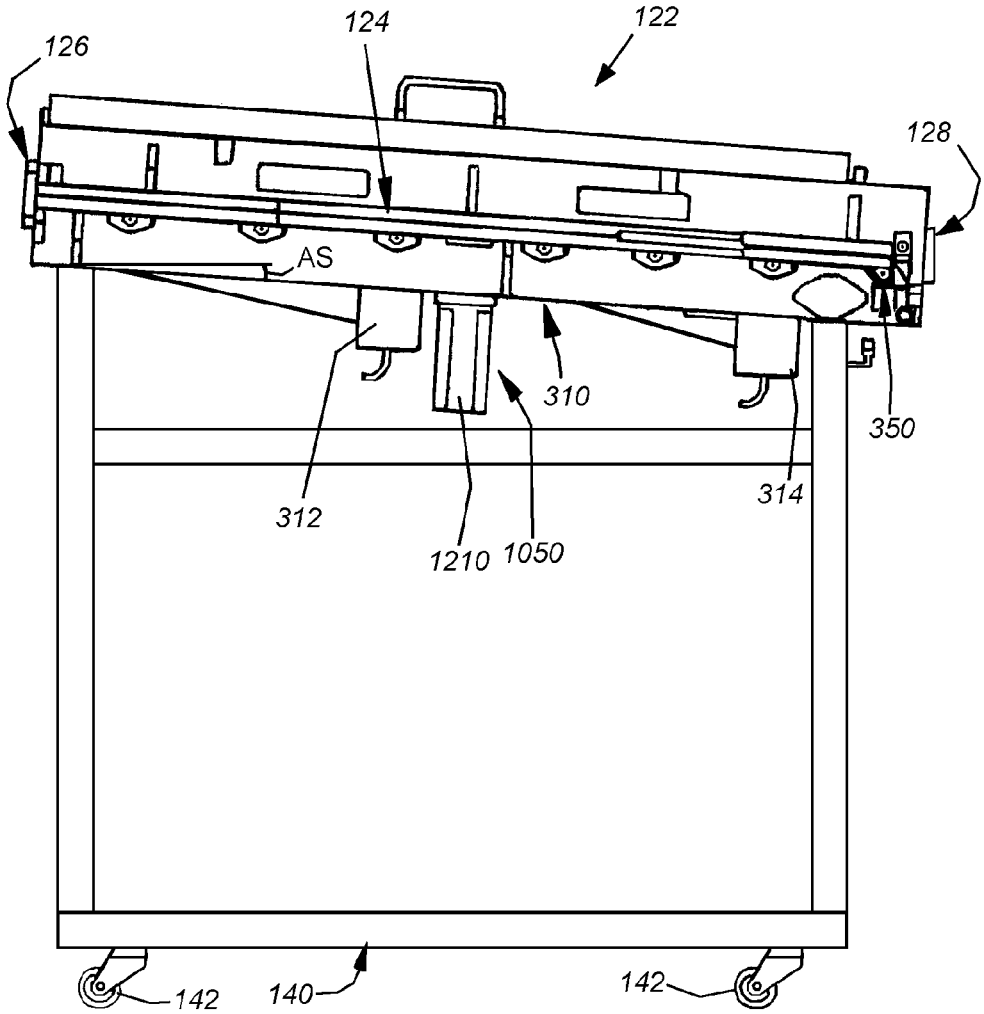
FIG. 3 is a more detailed side view of the sheet rotator of FIG. 1, taken along a right-hand side thereof.
Figure 4:
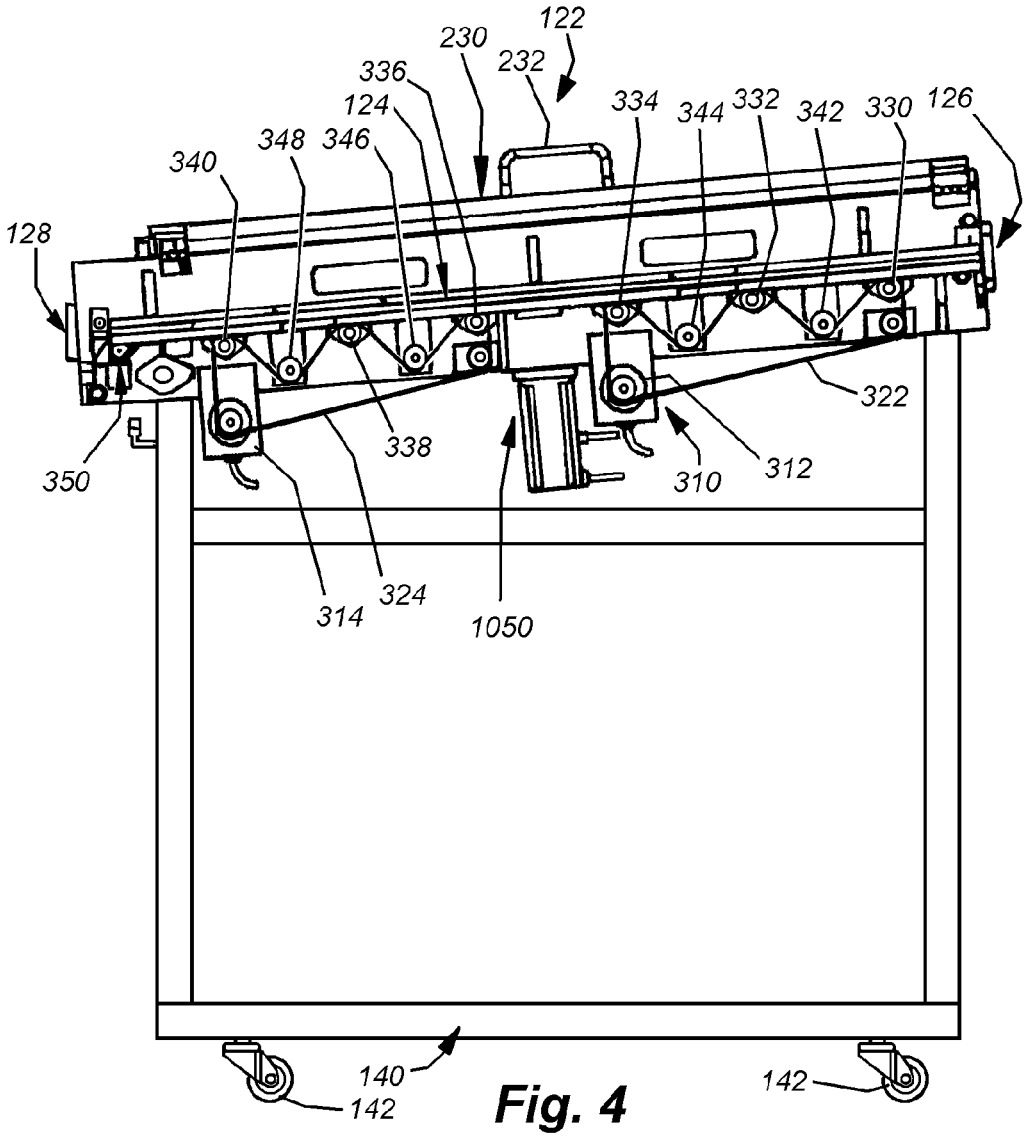
FIG. 4 is a more detailed side view of the sheet rotator of according to FIG. 1, taken along a left-hand side thereof.

As shown particularly in FIG. 2, the opposing sides of the feed table surface 124 are covered by corresponding sections of a top plate 220 that is spaced apart from the feed table surface 124 to provide a gap space 222 (shown in cutaway) with respect to the underlying feed table surface 124. This gap space 222 is sufficient to allow sheets of a variety of predetermined thicknesses (i.e. any conventional thickness) to pass between the top plate 220 and feed surface 124 without interference. A portion of the feed table surface 124, in a central region thereof, is not covered by the top plate 220, and is instead covered by a hinged cover assembly 230. The cover assembly 230 is shown hinged open in FIG. 6. A handle 232 can be provided to assist hinged opening of the cover assembly 230 along the opposing hinge line. The hinged cover assembly 230 allows the user access to the central region of the rotator 122 to perform service, adjustments, jam clearance, and other needed operations. In this embodiment, the feed table surface 124 and top plate 220 are narrowed (in a widthwise direction) at the upstream and downstream ends, and define a widened central region 240. The narrow-to-wide-to-narrow transition is an optional design feature. Alternatively, the entire surface can define the full width of the central region 240. As will be described below, the widened central region defines the sheet-rotation section of the rotator 122 and facilitates an enlarged radius that permits the unimpeded rotation of sheets in accordance with this invention.

Figure 6:
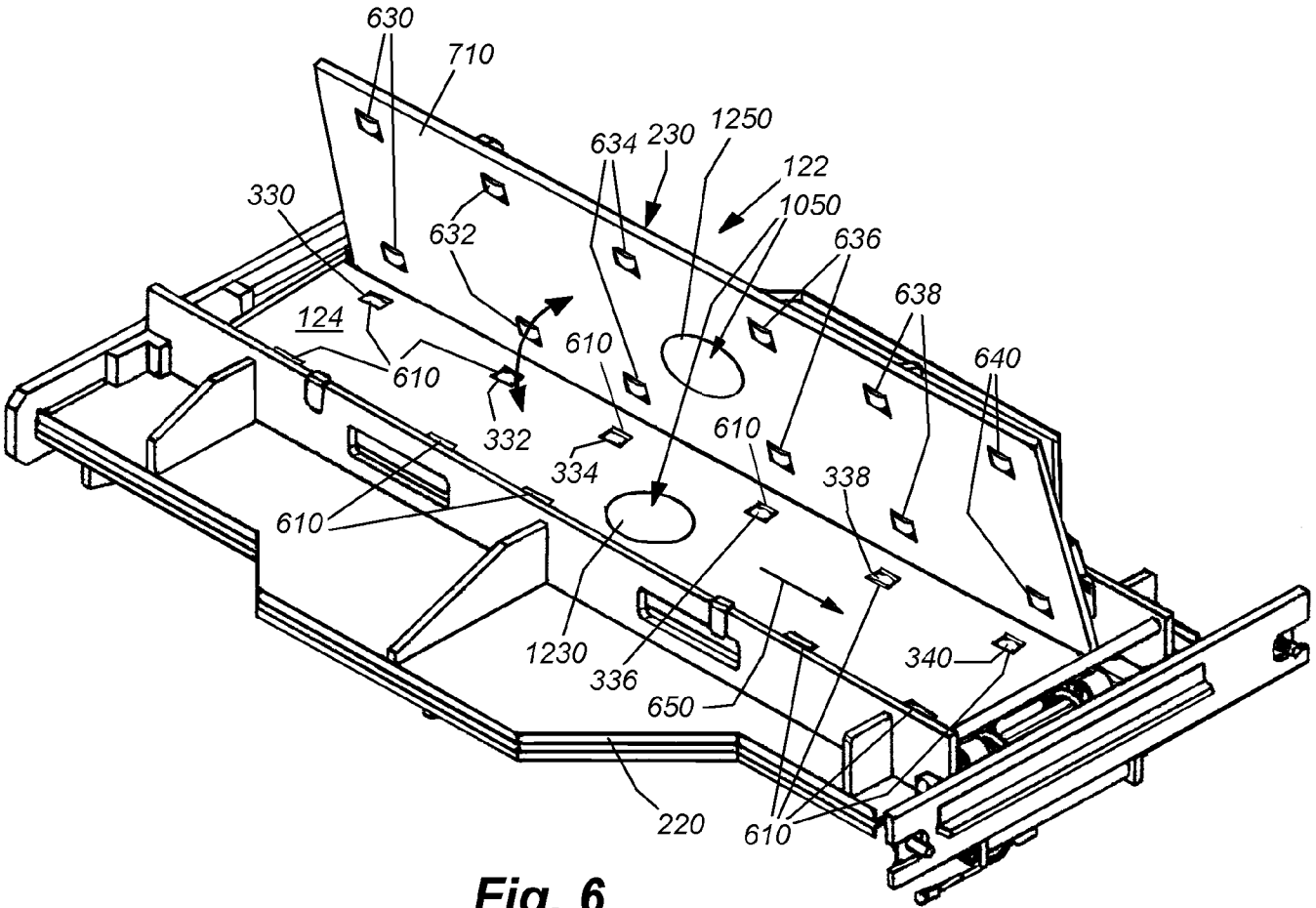
FIG. 6 is top perspective view of the sheet rotator of FIG. 1 with supporting legs omitted showing the nip roller cover in a raised orientation.

As shown further in FIG. 6, the top cover assembly 230 houses freely rotating nip rollers 630, 632, 634, 636, 638 and 640, that are constructed and arranged to overlie respective driven rollers 330, 332, 334, 336, 338, and 340 when the cover assembly 230 is lowered into a closed position (as shown, for example, in FIGS. 1-4). These nip rollers (also termed simply "nips") 630, 632, 634, 636, 638 and 640 respectively engage the driven rollers 330, 332, 334, 336, 338 and 340 to define a drive nip roller assembly that securely passes the sheets in a downstream direction (arrow 650) along the feed surface 124. Because each drive nip defines a pair of widthwise-spaced rollers, each rotating at an identical rate (on a common drive shaft), the drive nip passes a sheet located therebetween without skewing or lateral drift. As will be described further below, this facilitates the transport of sheets through the rotator 122 using as little as one nip roller pair, and enables sheets of various sizes to be continually engaged by at least one pair of rollers at all times during transport, eve as other nips along the transport feed path are disengaged to allow clearance for entering, exiting and rotating sheets. The size of the driven and nip rollers in this invention is highly variable. In an illustrative embodiment the contact surface of the rollers (driven and nip) each have a diameter of between approximately ½ inch and 1½ inch and an axial length approximately ½-1½ inches. These dimensions are highly variable. In alternate embodiments other types of drive components, such as belt assemblies may be employed.

Figure 5:
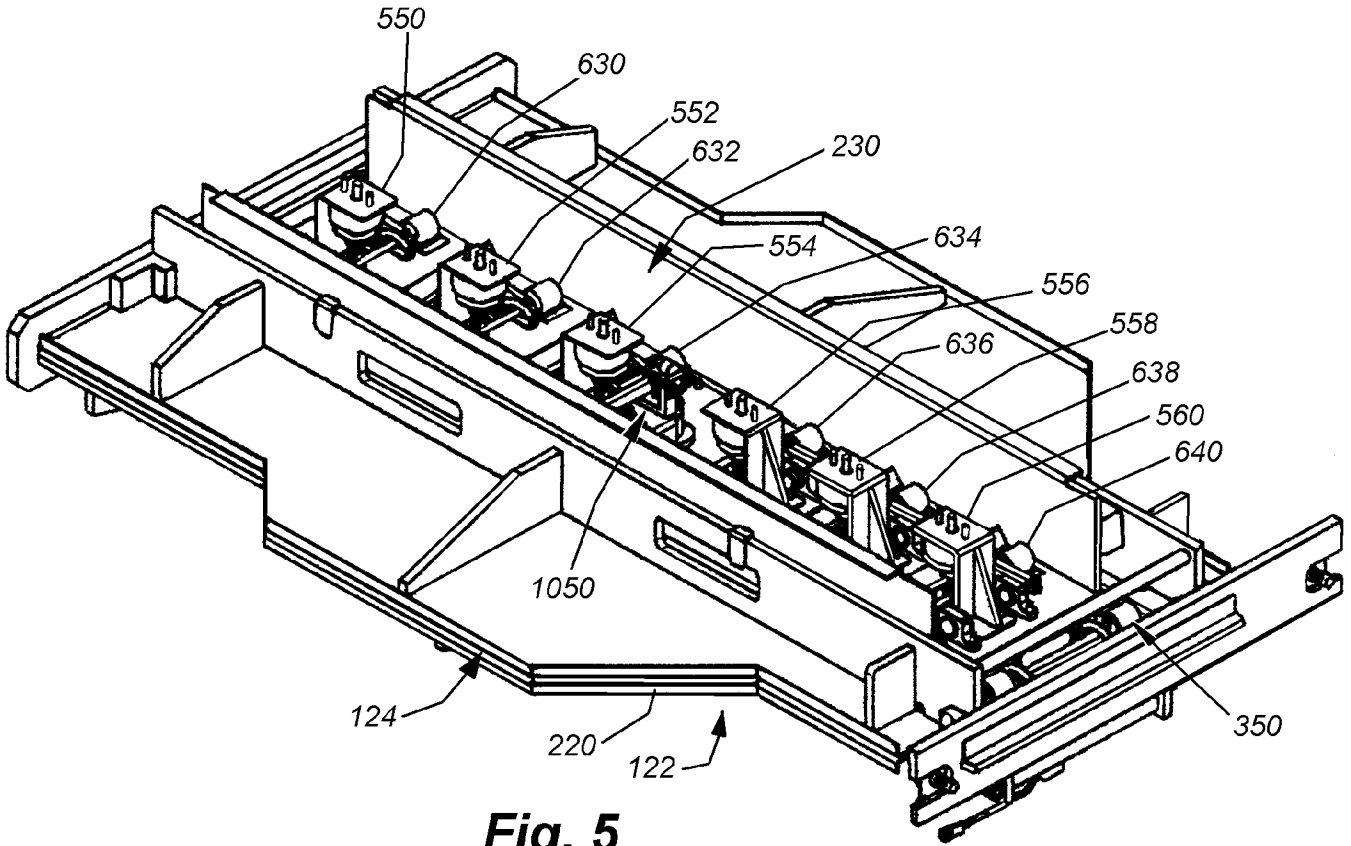
FIG. 5 is a bottom perspective view of the sheet rotator of FIG. 1 with supporting legs omitted for clarity.

The cover assembly 230 includes a top cover plate 250, which can be transparent or opaque. As shown in FIG. 5, when the plate 250 is removed, it reveals the internal mechanism of the cover assembly 230. The internal mechanism allows for the selective engagement of each set of nip rollers 630, 632, 634, 636, 638, and 640 with respect to their corresponding driven rollers 330, 332, 334, 336, 338 and 340. That is, each discrete pair of nip rollers can be moved into and out of engagement with their opposing driven rollers so as to selectively form a drive nip assembly or render the rollers undriven with a gap therebetween through which a sheet can pass free of interference. Selective engagement and disengagement of the nip assemblies (330 and 630, 332 and 632, 334 and 634, 336, and 636, 338 and 638, and 340 and 640) is achieved using respective solenoid assemblies 550, 552, 554, 556, 558 and 560 (or another controllable actuating mechanism) that selectively lifts each overriding, freewheeling nip roller pair out of engagement with the underlying driven roller pair. That is, when driving is desired, the solenoid or other actuator allows the nip roller pair to pressurably engage its confronting driven roller pair. Conversely, when it is desired to release the drive nip and provide clearance for sheet passage, the solenoid activates to lift the nip roller pair out of engagement with the driven roller pair. Independent activation of each of the nip assembly solenoids 550, 552, 554, 556, 558 and 560 is accomplished through the rotator's controller (910), which is described in further detail below.

Figure 7:
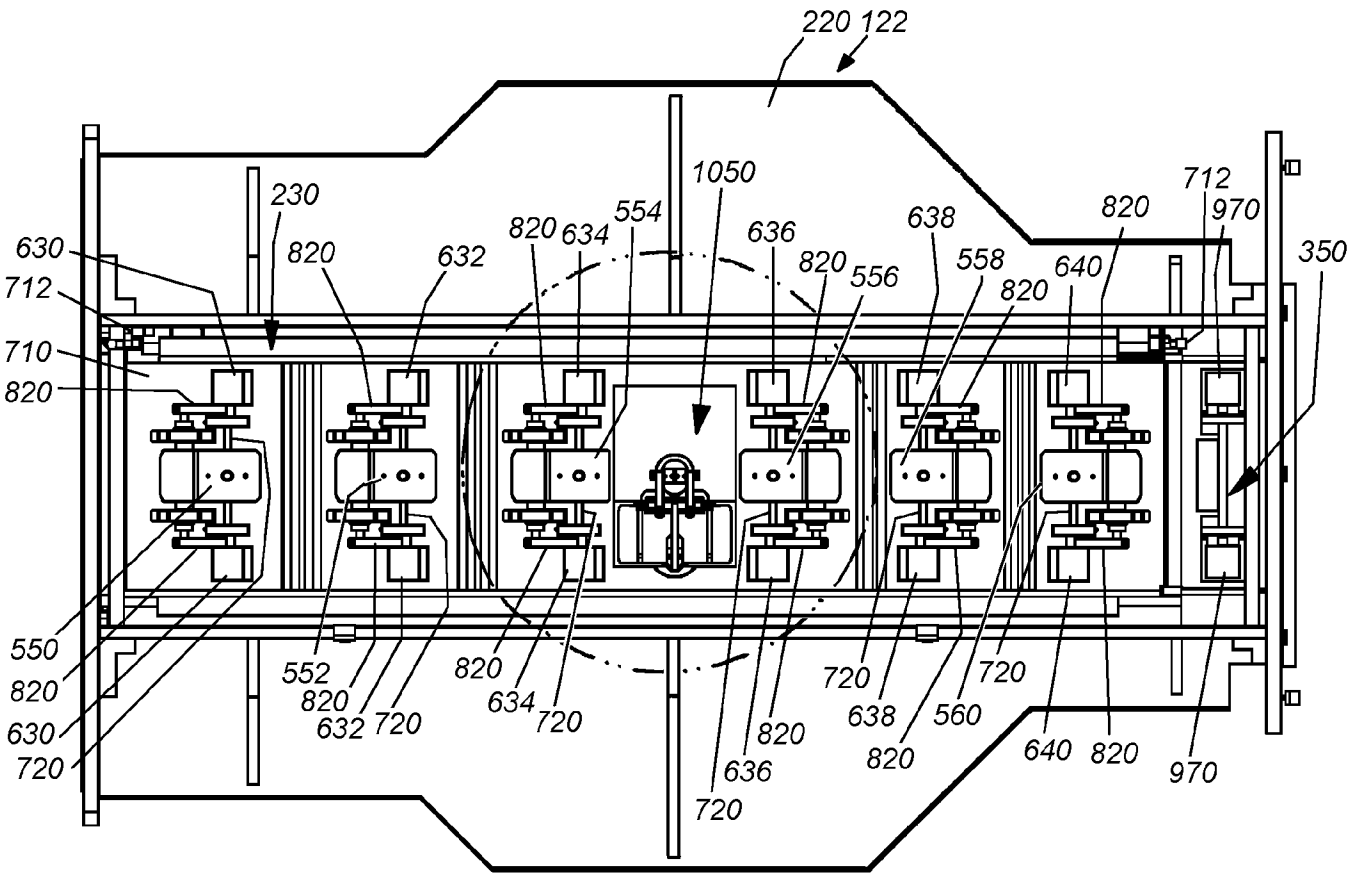
FIG. 7 is a bottom view of the sheet rotator of FIG. 1.
Figure 8:
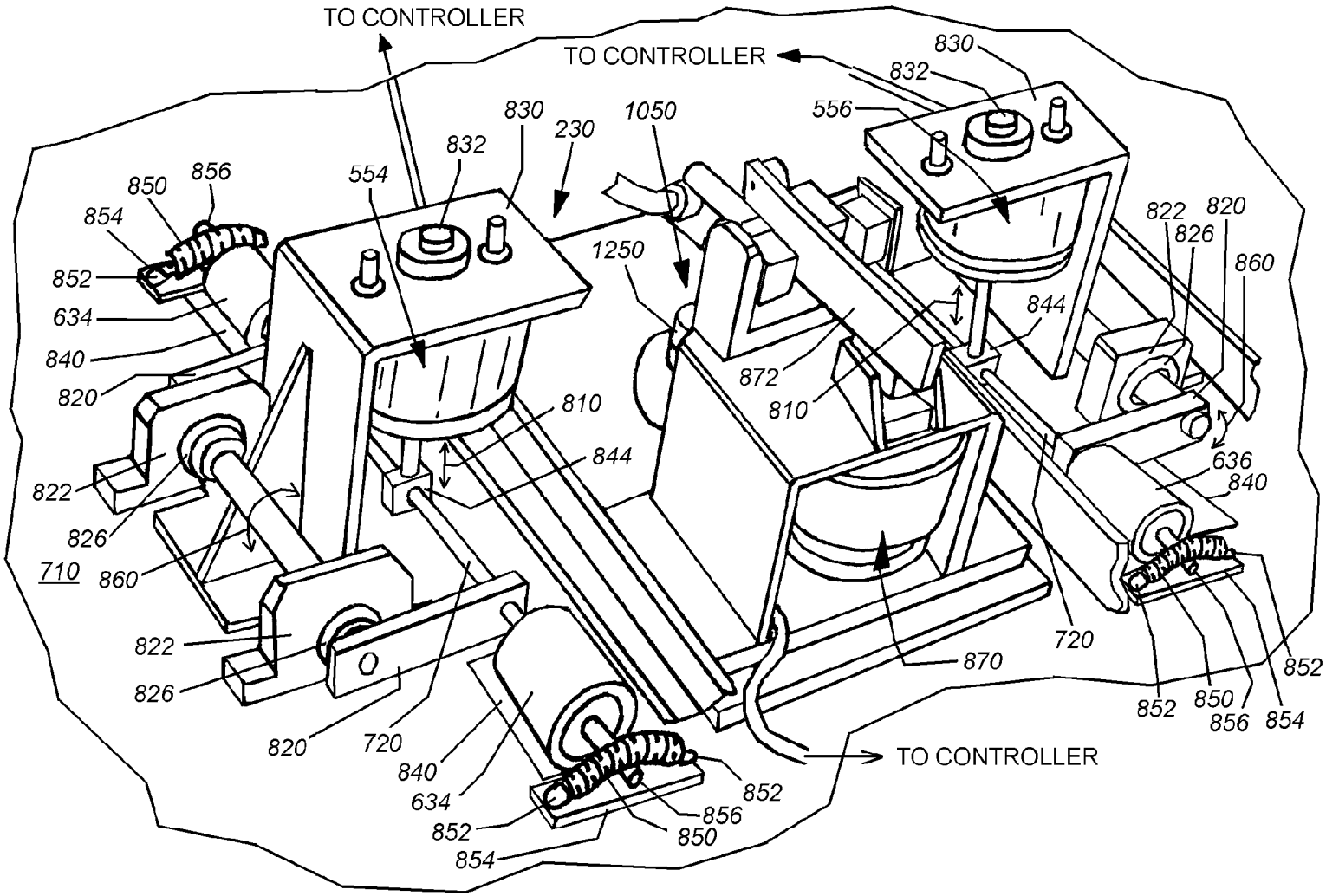
FIG. 8 is a partial perspective view of a pair of actuated nip rollers adjacent to a central rotator disk assembly according to an embodiment of this invention employed in the rotator of FIG. 1.

With further reference to FIGS. 7 and 8, the cover assembly's internal mechanism, including the structure and function of the nip assembly solenoids, is shown in further detail. The base plate 710 of the cover assembly 230 confronts the feed surface 124 when closed as shown. It resides in substantially the same plane as the surrounding top plate 220 so as to define a continuous gap (220) with respect to the feed table surface 124. A cover's (230) hinge assembly 712 enables the entire cover assembly 230 to be hinged toward and away from the feed table surface 124 so as to access at least a central portion of the feed surface 124 along substantially the entire upstream-to-downstream length of the rotator 122. Each pair of nip rollers 630, 632, 634, 636, 638 and 640 is joined together by an associated shaft 720. Each shaft 720 maintains the relative spacing of its rollers. The rollers can be mounted on corresponding bearings (not shown) that ride upon the shaft 720. The bearings are axially fixed, and enable free rotation of the rollers. The shaft 720 can be rotationally fixed.

With reference also to the more-detailed partial perspective view of FIG. 8, the individual solenoid assemblies 554 and 556 are shown by way of example, and represent the construction of all such assemblies in the rotator 122. Each of these solenoids is interconnected with the system controller (910 in FIG. 9) so that each solenoid is independently actuable, to move up and down (double arrow 810) as shown. The response time of the solenoid mechanism is sufficiently fast to accommodate a high speed stream of sheets as will be described further below. The shafts 720 are mounted on lever arms 820 that pivot with respect to mounting blocks 822 which are, themselves, secured to the cover assembly base plate 710. The mounting blocks 822 can include bearings 826 that facilitate rotation of the lever arms 820. The lever arms 820 ensure that the nip rollers on the shaft 720 carried by the arms 820 remain aligned axially and laterally with respect to their underlying slots 840 (in the base plate 710). In this manner, the shafts and associated nip rollers move through a short arc when moved upwardly away from engagement their respective driven rollers and downwardly toward engagement with their driven rollers, but are always maintained at the same contact point when engaged. Each solenoid (554, 556) is suspended above the respective nip roller shaft 720 by a corresponding L-shaped bracket 830. This bracket 830 allows the central armature 832 of each solenoid to pass therethrough as it is actuated upwardly and downwardly. The end of each solenoid armature 832 includes an attachment block 844 that can freely rotate with respect to the shaft 720, and thereby forms the operative interconnection between the shaft 720 and armature 832.

Each end 856 of each nip roller pair's shaft 720 is biased toward the base plate 710 and associated slots 840 by tension springs 850. The biasing spring assembly can be any acceptable spring arrangement such as the depicted springs 850, having each of opposing ends 852 secured to an underlying base plate 854 so that the shaft end 856 is secured between the spring 850 and the base plate 854. In this manner, the nip rollers are normally biased through their respective slots 840 to form an engaged nip with respect to an oncoming sheet. However, when a solenoid is activated by the controller to drive the armature 832 upwardly, the spring (850) bias is overcome, and the lever arms 820 rotate (double curved arrow 860) to guide the rollers upwardly away from their respective slots 840—thereby disengaging the drive nip and allowing a sheet to pass unimpeded between the nip assembly. In an illustrative embodiment, the nip roller pairs (630, 632, 634) upstream of the rotator assembly apply a force of approximately 16 pounds on the input sheets to ensure adequate engagement of a variety of types of sheet stock (including coated stock). The springs 850 in this upstream region are selected to provide this level of biasing force. The downstream nip roller pairs (636, 638, 640) apply a lower force of approximately 8 pounds. The associated solenoids that lift each nip roller pair are adapted to oppose this biasing force. In one embodiment, the upstream solenoids are chosen to 550, 552, 554 have a stronger applied lifting force than the downstream solenoids 556, 558 and 560. Alternatively, the downstream solenoids can be single units as shown, while the upstream solenoids can be mounted with respect to each upstream nip roller pair as a tandem set of twin solenoids per nip roller pair (not shown). Note that while a spring and solenoid assembly is used to bias and lift the nip roller pairs, alternate embodiments, the biasing and lifting can be accomplished by an actuator system. Likewise, the actuator system (or another arrangement) can be adapted to alter the biasing force exerted by the nip based upon the thickness and/or type of sheet stock being fed. By way of example, a lookup table can be provided to the controller to determine the appropriate biasing force for each nip roller pair given the input thickness, size and/or type of sheet.

Figure 9:
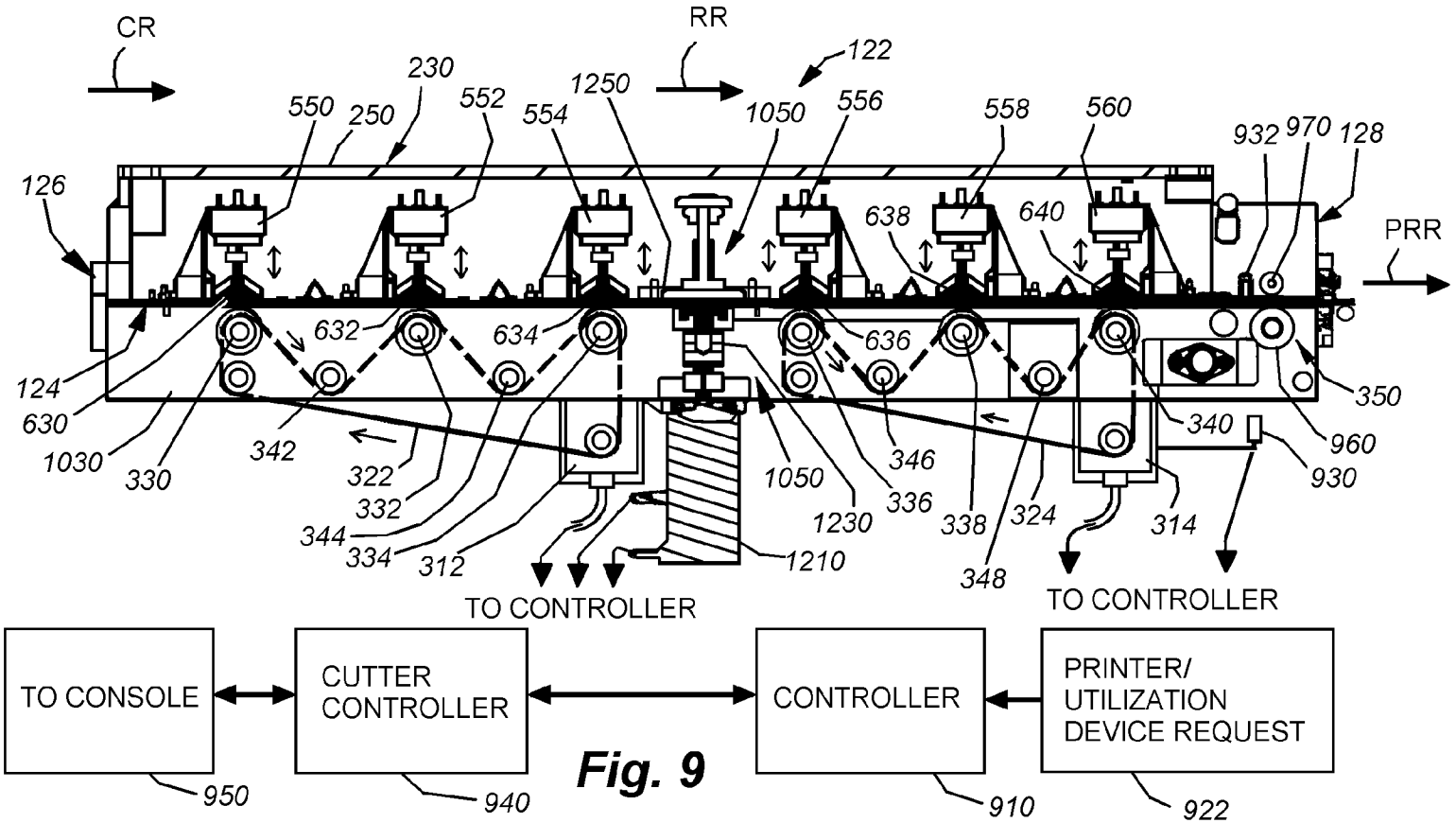
FIG. 9 is a side cross section of the sheet rotator of FIG. 1 detailing various drive mechanism and rotation components taken along a right-hand side thereof.
Figure 13:
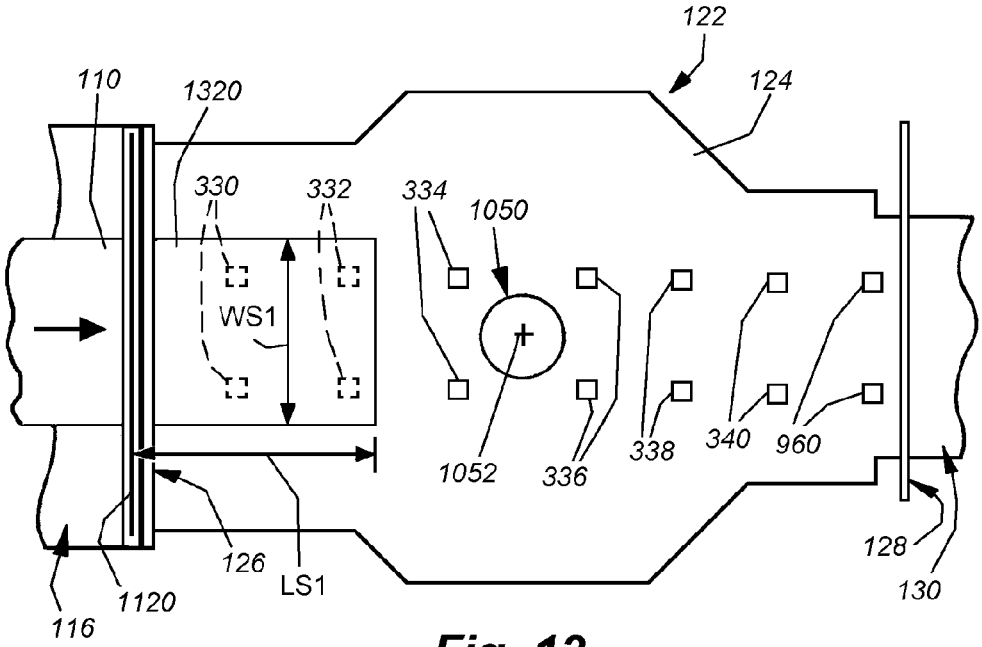
FIG. 13 is a partial top view of the sheet rotator feed table, adjacent upstream sheet cutter and downstream sheet utilization device of FIG. 1, in which the rotator receives the downstream end of a continuous web to thereby form a small-sized sheet, in accordance with a first feed mode.
Figure 14:
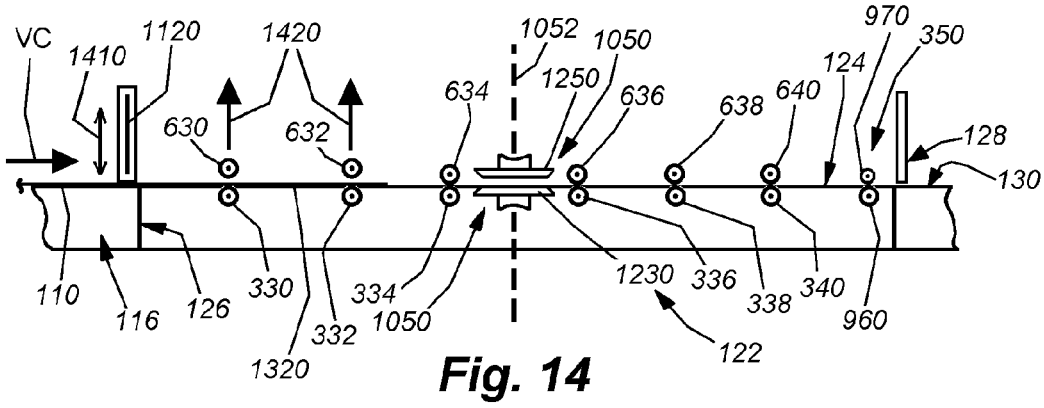
FIG. 14 is a partial side view arrangement of FIG. 13.

Reference is now made to FIG. 9, which shows the general arrangement of drive components in side cross section. In addition to the solenoid-actuated nips described above, the downstream end 128 of the rotator 122 includes a final outfeed drive assembly 350 that receives sheets from the upstream nips. The outfeed drive assembly 350 operates in conjunction with a printer/utilization device request signal (922) sent to the rotator's controller 910 and includes a clutch that allows it to comply to the draw rate of the particular utilization device's sheet-feed port. The input sheet rate (CR), radius of rotation (RR) and sheet exit rate (PRR) are shown in the FIG. 9. The controller 910 can be any acceptable electronic device including a microprocessor-based system that employs software or firmware consisting of computer-readable program instructions. Alternatively, the controller 910 can comprise state machine logic, or a combination of microprocessor and state machine logic. The controller 910 is operatively connected with the various actuable and driven components of the rotator 122, as well as various sensors. Such sensors can include jam detectors, sheet presence detectors and sheet velocity detectors. For example, a sheet presence sensor 930, comprising an optical sensing device is provided near the downstream end of the rotator 122. The optical sensor projects a beam through a slot (see slot 1310 in FIG. 13) in the feed table surface to indicate a jam or other condition that will cause the rotator to cease operation and/or signal an alarm. The controller 910 is also interconnected with an associated controller, or other control logic 940, which operates the cutter 116. A user-interface console 950 can be interconnected with the cutter controller 940 and/or the rotator controller 910. The console 950 allows the user to set sheet size, instruct whether or not sheets will be rotated, monitor system functions, and adjust various system parameters. It should be clear to those of ordinary skill that a variety of control and interface devices can be employed to carry out the various actuation and driving functions described herein.

Figure 10:
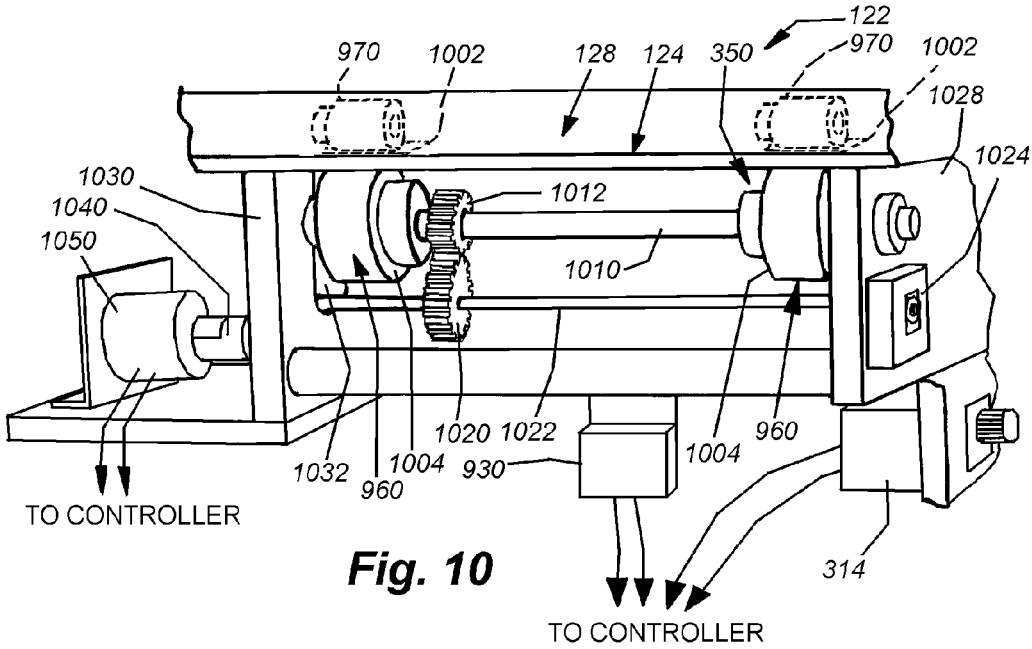
FIG. 10 is a fragmentary perspective view of the downstream outfeed roller for the rotator of FIG. 1.

With further reference to FIG. 10, the above-described outfeed drive assembly 350 is now described in further detail. It comprises a pair of driven outfeed rollers 960 that form a nip with a pair of freely rotating outfeed nip rollers 970 (shown in phantom) that engage the driven outfeed rollers through respective slots 1002 (shown in phantom) in the feed table surface 124. The driven rollers 960 can include an elastomeric surface 1004 that generates a frictional grip on sheets passing therethrough. Likewise, the nip rollers 970 can include a smooth or elastomeric surface. Other surface textures that enable grip (such as a textured surface, are also contemplated.

As shown in FIG. 10, the driven rollers 960 are is connected by a central shaft 1010 that includes a driven gear 1012. The driven gear 1012 is fixedly mounted on the shaft 1010 and the shaft 1010 is fixedly attached to the driven rollers 960 so that rotation of the gear 1012 causes corresponding rotation of the rollers 960. In alternate embodiments, the rollers 960 can be attached to the shaft 1010 using one-way bearings that allow the shaft to drive the rollers in a downstream direction, but enable a sheet to be drawn at a faster draw rate than the roller rotation rate by the utilization device if required. The driven gear 1012 is driven by a drive gear 1020 that is located on a drive shaft 1022 positioned below the driven shaft 1010. The drive shaft 1022 extends, at one end, through a bearing block 1024 mounted on a side plate 1028 of the rotator's frame. This side plate 1028 also supports the other nip roller shafts and idlers as described above. The opposing rotator frame side plate 1030 includes a slot 1032 through which the opposing end of the drive shaft 1022 passes. This opposing shaft end is connected to a universal joint 1040 that is, itself, interconnected with a clutching motor 1050. The clutching motor drives the shaft 1022, and allows slippage where appropriate. This enables the draw of the sheets into the utilization device 130 to occur at the utilization device's native draw rate without relation to the actual drive speed of the motor 1050.

In an embodiment of the invention, an actuator (not shown) can allow the two outfeed assembly shafts 1010 and 1022 to be moved away from each other so that the rollers 960 are completely disengaged from the drive. This enables selective driving of the rollers 960 when desired. In such an embodiment, the opposing supports (block 1024 and slot 1032) can be adapted to allow the shaft ends to slide upwardly and downwardly. The above-described universal joint on the drive shaft 1020 can be used to facilitate the upward/downward translation of the drive shaft on appropriate supports.

Figure 11:
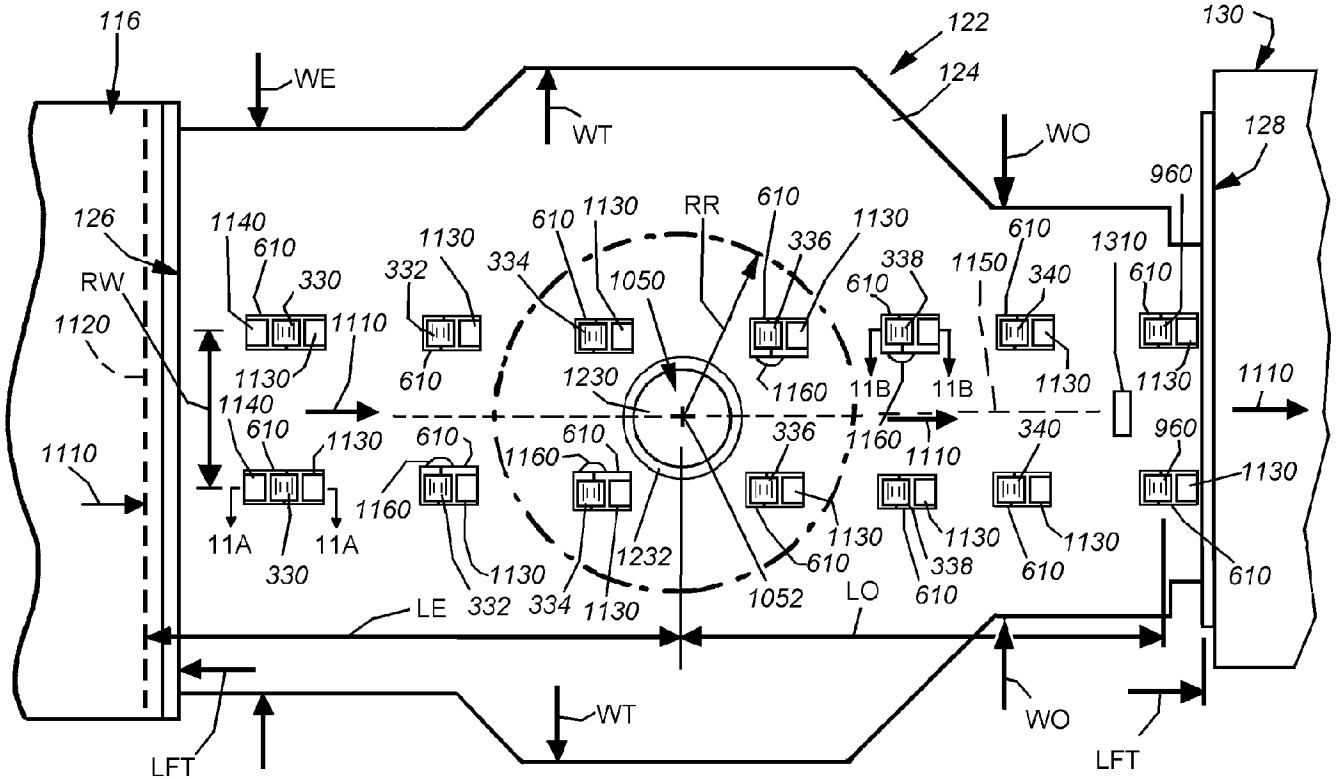
FIG. 11 is a partial top view of the sheet rotator feed table, adjacent upstream sheet cutter and downstream sheet utilization device of FIG. 1, showing the arrangement of drive and rotation components according to an illustrative embodiment.

FIG. 11, thus, details the overall arrangement of the feed table surface 124 with included rollers 330, 332, 334, 336, 338, 340 and 960. As will be described in detail below, the rollers are arranged to accommodate cut sheets of a variety of lengths and widths. In particular, in one embodiment, the rollers are each separated by an approximate width RW (perpendicular/orthogonal to the upstream-to-downstream RW taken from each roller's center) that is approximately between 4 inches and 7 inches. The value of width RW is widely variable. The rollers are spaced apart between approximately 3 and 6 inches along the lengthwise (upstream-to-downstream) direction. In one embodiment, the overall length LFT of the feed surface 124 is approximately 40-42 inches. The overall width WT at the widest point of the feed table 124 can be approximately 22-25 inches. The prevailing width of the feed table 124 can be somewhat narrower at the entrance (width WE) and output (width WO) of the feed surface 124. In alternate embodiments, a widened width can be defined along the entire surface. The width should be sufficient to accommodate the widest webs to be input and the widest rotated sheets to be output. The feed table's central region is wider to accommodate the radius of rotation (RR) of the sheet rotator disk assembly 1050 according to an embodiment of this invention. This region can be termed the rotation section. That is, when rotating sheets, it is necessary to accommodate the rotational movement of their corners, which extends to a longer radius than either the lengthwise or widthwise dimension of the sheet when it is positioned orthogonally with respect to the downstream direction.

Figure 11B:
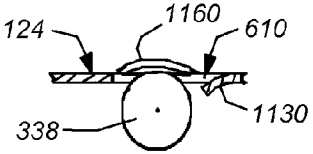
FIG. 11B is a partial cross section taken along line 11B-11B of FIG. 11 through a driven roller and surrounding slot adjacent to the rotator disk assembly on the sheet rotator feed table, showing the surrounding ramp arrangement and dome-shaped sheet deflector.
Figure 11A:
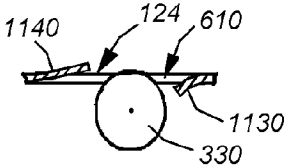
FIG. 11A is a partial cross section taken along line 11A-11A of FIG. 11 through a driven roller and surrounding slot at the upstream end of the sheet rotator feed table, showing the surrounding ramp arrangement.

To assist in the feeding of sheets downstream, each slot 610 through which a predetermined driven roller 330, 332, 334, 336, 338, 340, 960 passes is formed with downward-bended ramps 1130 (FIGS. 11A and 11B) on the downstream edge thereof. Refer in FIG. 11 to the downstream direction by arrows 1110. These downward-bended ramps 1130 prevent the leading edge of each fed sheet from colliding with the downstream edge of each slot 610 as the sheet moves downstream. The downward bend is formed 9 in this embodiment, by extending the downstream cut of the slot 610 by approximately ¼-¾ inch and downwardly bending the ramps 1130 as shown. The upstream tip of the ramp can be deflected downwardly from the surrounding table by approximately ⅛-¼ inch in an illustrative embodiment. Likewise, the slots 610 surrounding the upstream-most rollers 330 define an upwardly bended ramp 1140 that prevents an incoming sheet from the cutter 116 from becoming bound up on the rollers 330 as it is driven downstream with the nip of the rollers 330, 630 disengaged. That is, the leading edge of each incoming sheet will ride up over the rollers 330, without binding thereon. The ramps 1140 are formed similarly to the downward-bended ramps 1130, with an upward deflection of between approximately ⅛-¼ inch with respect to the table surface.

Figure 12:
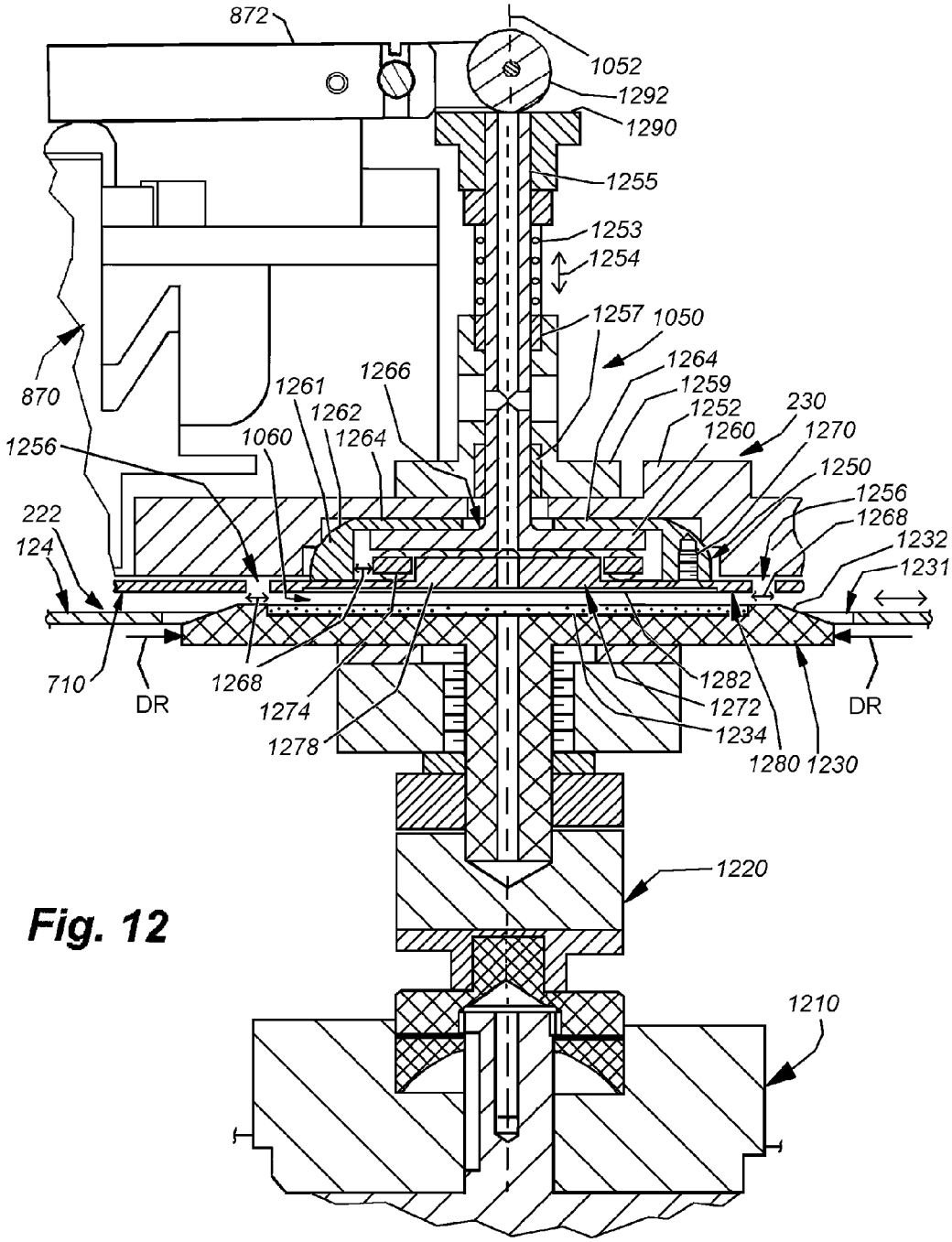
FIG. 12 is a side cross section of the central rotator disk assembly including the driven rotator disk and pressure disk of the rotator of FIG. 1.

With further reference to the roller slots 610 of FIG. 11, an additional feed table (124) feature, which assists the jam-free rotation of sheets (described further below) is the formation of domed segments 1160 at the edges of the slots 610 adjacent to the rollers 332, 334, 336 and 338 on opposing sides of the table centerline 1150. These domed segments (see FIG. 11B). The domed segments can extend upwardly above the table surface 124 by a height of approximately ⅛-¼ inch. They allow for a rotated sheet to pass over the adjacent rollers without binding thereupon during rotation. Since rotation occurs in a counterclockwise direction described below) in this embodiment, the upstream domes (for rollers 332, 334) are placed only adjacent the right-side rollers, while the downstream domes (for rollers 336, 338) are positioned only adjacent the left-side rollers. In alternate embodiments, domes can be placed adjacent to both of the rollers in a pair. The rotator disk assembly 1050 will now be described with reference to FIGS. 1-8 and the more detailed cross-section of the rotator disk assembly 1050 as shown in FIG. 12.

The rotator disk assembly 1050 is centered in a widthwise direction with respect to the feed table 124. More particularly it is defined by a central rotation axis 1052. The axis 1052 is spaced approximately 22-24 inches (distance LE) from the cutter's (116) cutter blade (dashed line 1120). The axis 1052 is also spaced approximately 22-24 inches (distance LO) from the rotation axis of the outfeed rollers 960. The dimensions are highly variable depending upon the size of sheets to be handled. The rotator disk assembly 1050 is adapted to rotate by ninety degrees to thereby rotate sheets centered thereon by a corresponding ninety-degree angle (perpendicular/orthogonal). The rotator disk assembly 1050 includes a bottom-mounted rotary actuator 1210 that is shown partially in FIG. 12. The actuator 1210 receives signals from the controller 910 at the appropriate time to allow rotation of sheets centered on it. The actuator 1210 can comprise a rotary solenoid, electrically operated servo, stepper motor, or any other actuator that is capable of achieving at least a ninety-degree rotation, and perform this function at a sufficient rotation speed so as to enable the tables native feed rate, as described herein. In an illustrative embodiment, a sheet rotation of 90 degrees occurs in 35 milliseconds or less. Also in the illustrative embodiment, a servo motor is employed as the rotary actuator 1210. In alternate embodiments, the rotator disk assembly 1050 can rotate between other arc distances, such as 180 degrees or 270 degrees. Likewise, where a particular application calls for a non-orthogonal/perpendicular rotation (e.g. 30 degrees), the rotator disk assembly can be modified to produce such rotation.

As shown, the actuator is coupled by a coupling 1220 to the driven rotator disk 1230. The driven rotator disk 1230 resides within a circular, open well 1231 that passes through the surface of the feed table 124, and as shown, projects slightly above the surface (for example, approximately 1/32-⅛ inch above). A beveled outer edge 1232 on the driven rotator disk 1230 allows incoming sheets to slide over the disk edge without binding as they are driven downstream by the upstream nip rollers (330, 332, 334). The center region 1234 of the driven rotator disk 1230 can include a well, or as shown, can include a frictional insert (1234) constructed from an elastomer. One acceptable elastomer is EPDM. The gap 222 in the rotator 122 through which sheets pass is clearly depicted between the feed table surface 124 and the opposing cover assembly plate surface 710 in FIG. 12. The diameter DR of the driven rotator disk 1230 is highly variable. In one embodiment, it has a diameter of between approximately 1½ and 4½ inches, and illustratively, DR is approximately 3.5 inches. The disk 1230 (and the opposing pressure disk 1250 described below) is constructed from a lightweight aluminum allow. However polymer, or another durable material, can be employed to construct either disk 1230, 1250.

An opposing pressure disk 1250 overlies the driven disk 1230 in the rotator disk assembly 1050. The pressure disk 1250 is mounted in a bearing support 1252 that is attached to the base plate 710 of the cover assembly 230. The pressure disk 1250 rotates on a common axis 1052 with respect to the driven disk 1230. The pressure disk 1250 is normally biased into an upward, retracted position by the spring 1253, and is movable axially (double arrow 1254) within its support 1252 against the spring bias, downwardly toward the driven disk 1230 under action of the solenoid assembly (described below with reference to 870 in FIG. 8). The main shaft 1255 of the pressure disk 1250 slides with respect to bearings 1257 mounted in the base support 1259. Thus, the pressure disk 1250 includes a disk shaped end piece 1260. The end piece 1260 is nested within a bell-shaped upper housing 1261 having a having a flat top surface 1264 and a rounded, or otherwise chamfered top perimeter edge 1262. The top surface bears against the disk 1260 and includes a clearance 1266 of approximately ⅛-¼ inch with respect to the main shaft 1255. This clearance 1266 allows the upper housing to move laterally (double arrows 1268) with respect to the shaft 1255 and corresponding axis 1252. The upper bell-shaped housing 1261 is attached (fastener 1270) to a pressure disk contact plate 1272 that confronts the driven rotator disk 1230. A ball bearing assembly 1274 is positioned between the inner face of the plate 1272 and the bottom pace of the disk 1260. The bearing assembly maintains a predetermined spacing between the housing 1261 and the disk 1260. The bearing assembly surrounds a raised center 1278 of the plate interior. In this manner, the housing 1261 and plate 1272 have a limited range of lateral movement (particularly when actuated into an engaged position against the driven disk 1230) and free rotation with respect to the axis 1252. This ensures that the pressure disk will not slip on the sheet due to minor misalignments. Rather it will rotate with some eccentricity. Such minor misalignments can occur due to play in components that becomes induced during the opening and closing of the cover 230. In this embodiment the outer perimeter edge 1280 of the plate 1272 provides the main pressure source bearing against sheets, while the center of the plate includes a slight recess 1282 (approximately 1/32-1/16 inch in depth), which concentrates engagement pressure at the perimeter edge 1282. Note that the bell-shaped housing 1261 and disk 1260 can include therebetween a centering mechanism constructed according to conventional technique—for example using a plurality of balanced springs positioned between the bearing assembly 1274 and the inner wall of the housing 1261 at various locations around the perimeter therebetween.

As shown further in FIG. 12, the pressure disk 1250 is retracted upwardly to fit flushly against, and within, a recess 1256 of the base plate 710. In this manner, a gap 1060 remains for sheets to pass therebetween. With further reference to FIG. 8, a solenoid assembly (or other linear actuator) 870 operates a lever arm 872 that is operatively connected to the pressure disk shaft end 1290 by a bearing surface 1292. A variety of interconnections between the actuator and pressure disk assembly are contemplated in alternate embodiments. When instructed by the controller 910, the solenoid 870 moves the disk assembly into a pressurably engaged position with respect to the driven disk 1230, and when the solenoid is reversed or depowered, the spring 1253 biases the disk assembly back into the disengaged position (as shown) where the gap 1060 is provided. In the disengaged position, sheets can move into and past the rotator disk assembly 1050 under the drive of the nip rollers. When sheets are directed to, and centered with respect to, the axis 1052, the solenoid assembly 870 can be instructed to lower the pressure disk 1250 into a pressurable engagement with the driven disk 1230. This engagement allows for a significant gripping pressure upon the sheet. This gripping pressure ensures that the sheet will rotate when the driven disk 1230 is rotated by the rotary actuator 1210. The pressure disk 1250 rotates to follow the rotation of the driven disk 1230 during this rotation. In various embodiments, the pressure disk 1250 and/or the driven disk 1230 can include an elastomeric insert (such as insert 1270) to increase gripping friction. The pressure applied between the disks 1230, 1250 is highly variable. In general, the larger diameter the confronting disks, the less pressure is needed due to the overall force-per-square-unit applied to the sheet. In one embodiment, the engagement pressure is approximately 18 pounds. However, in alternate embodiments, the applied pressure can be varied based upon the thickness, size and/or type of sheet stock.

Having described the general construction of the sheet rotator 122 according to an embodiment of this invention, a detailed discussion of the sheet rotator's operation in a variety of feed and rotation modes will now be discussed in further detail. In general, the selectively actuable nip roller assemblies, drive motors and the rotator disk assembly are arranged so as to enable a wide range of sheet lengths and widths to be fed and rotated without the need for adjustable edge guides and other structures that add complexity and thereby increase the possibility of jams and misfeeds. The arrangement allows at least one pair of rollers and/or the rotator disk assembly to remain in pressurable contact with a sheet at all times during the sheet's transport along the feed table 124. In this manner, the sheet does not drift out of the desired feed path or become skewed with respect to the feed direction. As a general rule, the controller times the engagement and disengagement of components so that at least one set of components is in positive engagement of the sheet before an adjacent component disengages.

II. Rotator Operation in Various Feed Modes

A. Mode 1

FIGS. 13-22 show the operation of the sheet rotator 122 in a first mode of operation in which sheets that are relatively short in length and narrow in width are fed from the continuous web 110 through the cutter blade 1120 and onto the table 124 of the sheet rotator. In this embodiment, for example, the sheets can have a length LS1 of approximately 10-14½ inches, and a width WS1 7-12 inches when initially cut (the cutting action of the cutter blade 1120 being represented by the double arrow 1410 in the corresponding side view of FIG. 14). As the leading, downstream end of the web 110 is fed through the cutter 116, and onto the feed table 124, the first two nip roller pairs 630 and 632 are raised (arrows 1420) by their respective actuators so as to not interfere with the movement of the sheet (which is a downstream end of the web 110) at a cutter feed rate (arrow VC). The cutter feed rate VC can be faster than the rotator's feed rate herein so that the feed is delivered rapidly to the table 124. Once the sheet 1320 is separated from the upstream web 110, the nip rollers 630 and 632 are lowered (arrows 1620 in FIG. 16) by their actuators at the appropriate time (as determined by the controller 910) to allow the engaged nips 330, 630 and 332, 632 to drive the sheet downstream at a rotator main driving rate (arrow VM) so as to be centered with respect to the rotator disk assembly 1050. As the sheet moves downstream, it is also engaged by nips 334, 634 and 336, 636 on opposing sides of the rotator disk assembly. The rotator rate VM can be constant, dictated by the servo motors 312, 314, or it can vary depending upon the length of sheets being fed, as well as other factors, such as the rate of the utilization device's feed.

Figure 15:
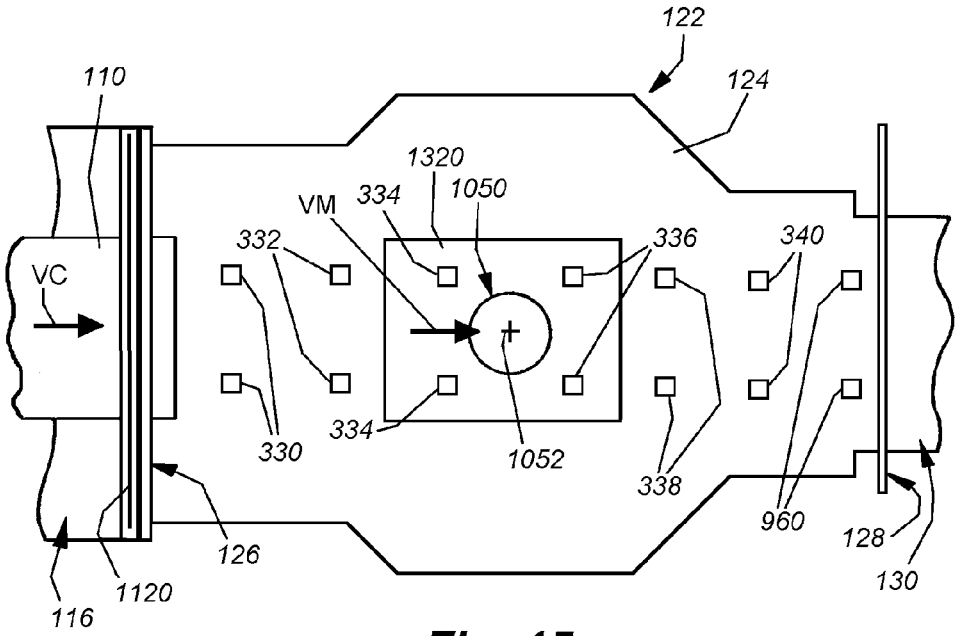
FIG. 15 is a partial top view of the sheet rotator feed table, adjacent upstream sheet cutter and downstream sheet utilization device of FIG. 1, in which the sheet is moved to a centered location with respect to the rotator disk assembly while the cutter delivers a new downstream web end to the rotator in accordance with the first feed mode.
Figure 16:
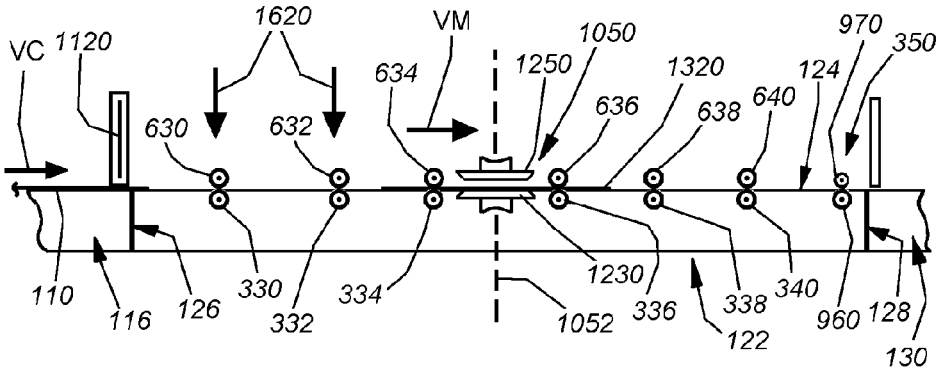
FIG. 16 is a partial side view of the arrangement of FIG. 15.

As shown in FIG. 15, the newly cut sheet 1320 has been transported by the driven rollers 330, 332, 334 and 336 into the centered position with respect to the rotator disk assembly 1050. Each motor 312, 314 is directed by the controller's program to stop when the sheet has travelled an appropriate distance. The user-input sheet length enables the controller to calculate the appropriate travel distance. The sheet 1320 is moved at a timing and velocity VM that is sufficient to center it on the rotator before another sheet is directed by the cutter 116 at the velocity VC. In this example, the long direction LS1 of the sheet is in the downstream direction. The rotator disk assembly 1050 will now act to rotate the sheet so that its shorter dimension WS1 is in the downstream direction. Note that the length and width dimensions can be interchanged at the cutter (e.g. feeding the shorter dimension in the upstream-to-downstream direction from the cutter in accordance with this mode).

Figure 17:
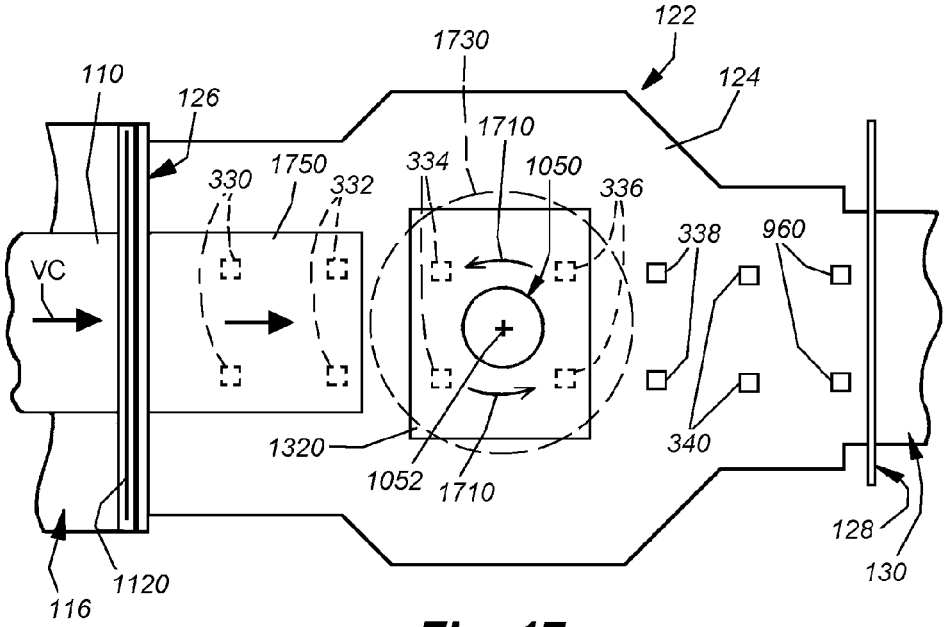
FIG. 17 is a partial top view of the sheet rotator feed table, adjacent upstream sheet cutter and downstream sheet utilization device of FIG. 1, in which the sheet is rotated approximately ninety degrees while a second sheet is delivered and cut at the upstream end of the rotator in accordance with the first feed mode.
Figure 18:
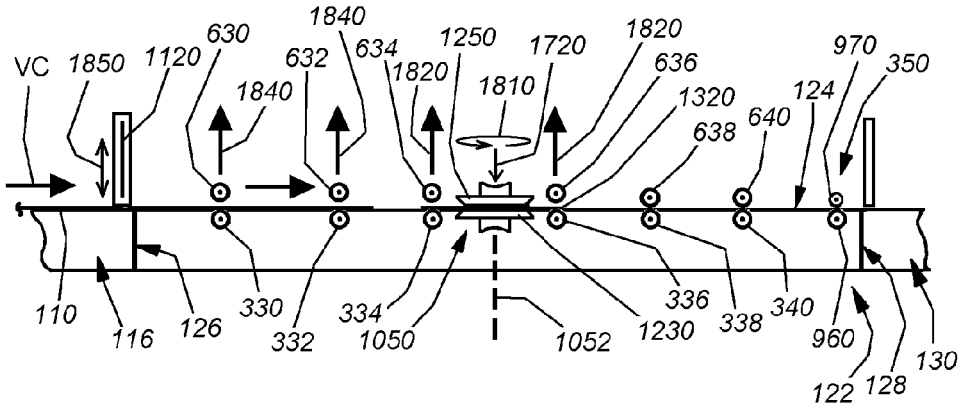
FIG. 18 is a partial side view of the arrangement of FIG. 17.

In particular, with reference to FIGS. 17 and 18, the sheet 1320 is rotated (curved arrows 1710) by ninety degrees. To facilitate rotation, the actuatable pressure disk 1250 is lowered (arrow 1810) to compress the sheet 1320 between itself and the lower driven disk 1230. After a short delay so as to maintain continuous sheet engagement, the adjacent actuated nip roller pairs 634 and 636 are raised by their respective actuators (arrows 1820). The sheet 1320 is then free to rotate as indicated by the rotation radius circle 1730 (shown as a dashed circled) under the action of the rotator disk assembly. The size (LS1×WS1) of the sheet 1320 is such that the circle 1730 does not impinge upon the next upstream or downstream nips 638 and 623. Thus, these nips need not be raised at this time. However, since another sheet is being driven from the cutter 116 (arrow VC), the nips 630 and 632 are momentarily raised (arrows 1840) at the time that the cutter 116 feeds the next downstream web end to accommodate its entrance onto the upstream end 126 of the feed table 124. At the appropriate time, the cutter blade 1120 is actuated (double arrow 1850) to separate this new sheet 1750. In this mode, the rotated sheet 1320 and a new upstream sheet 1750 now simultaneously reside on the feed table 124.

Figure 19:
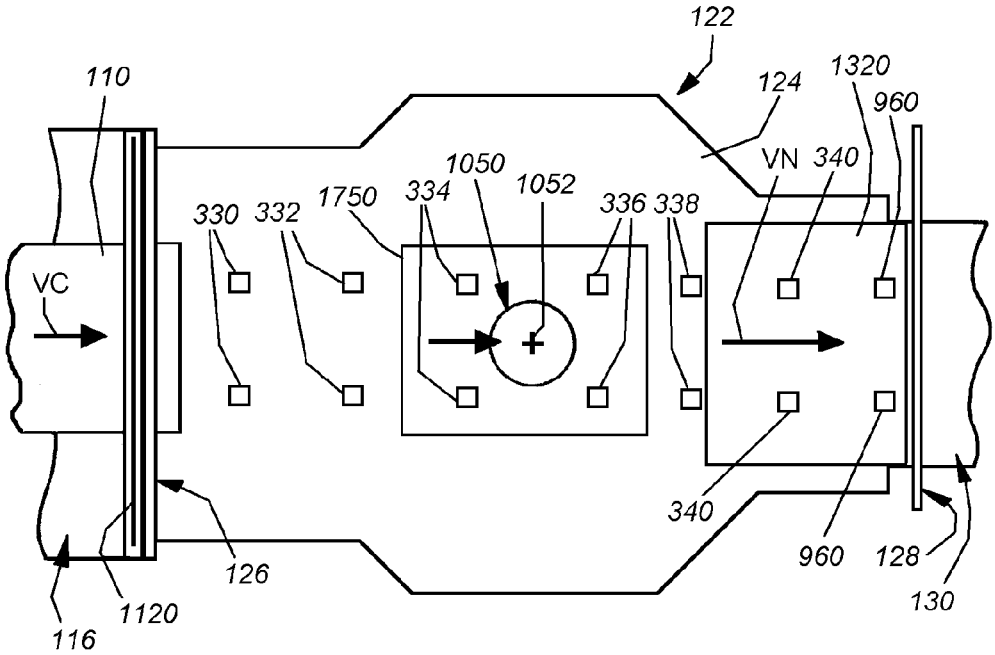
FIG. 19 is a partial top view of the sheet rotator feed table, adjacent upstream sheet cutter and downstream sheet utilization device of FIG. 1, in which the rotated sheet is directed into the utilization device while the upstream sheet is directed into a centralized location on the rotator disk assembly and a downstream end of the web is ready to be delivered to the rotator in accordance with the first feed mode.
Figure 20:
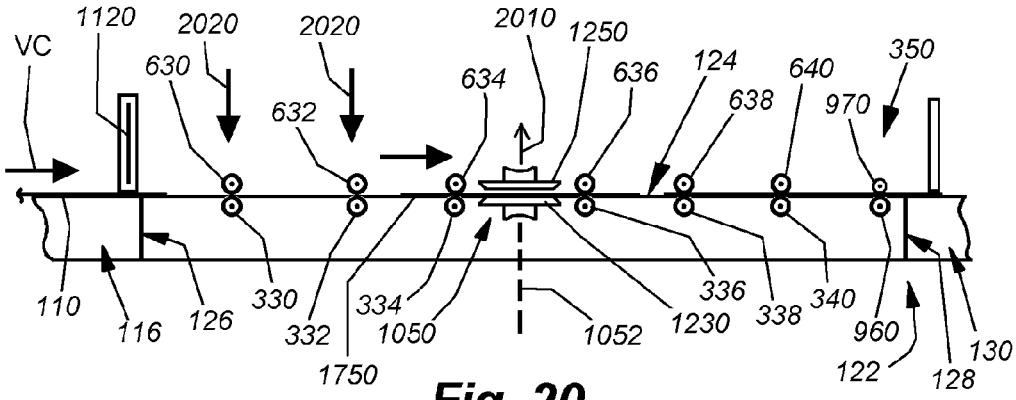
FIG. 20 is a partial side view of the arrangement of FIG. 19.

Next, according to FIGS. 19 and 20, the actuable pressure disk 1250 is again raised (arrow 2010) while the upstream nips 630 and 632 are lowered (arrows 2020). The rotated sheet 1320 is directed further downstream (arrow VN) into the downstream most nip roller assemblies 338, 638 and 340, 640, as well as the outfeed roller assembly 350. The sheet 1320 is drawn at the utilization device's feed rate into the utilization device 130 by the clutched outfeed roller assembly 350 and the utilization devices sheet feeder not shown). The centered sheet 750 awaits rotation. Likewise, the web end 110 is directed downstream (arrow VC) by the cutter 116 to form a new sheet with respect to the nips 630 and 632. While not shown, one or both of the downstream nip roller pairs 638 and 640 may be raised to disengage from the sheet when it becomes engaged by either the outfeed roller assembly 350 or the utilization device's feeder. This prevents the sheet from being driven at two separate drive rates that may cause slippage of the sheet with respect to one of the drive assemblies.

Figure 21:
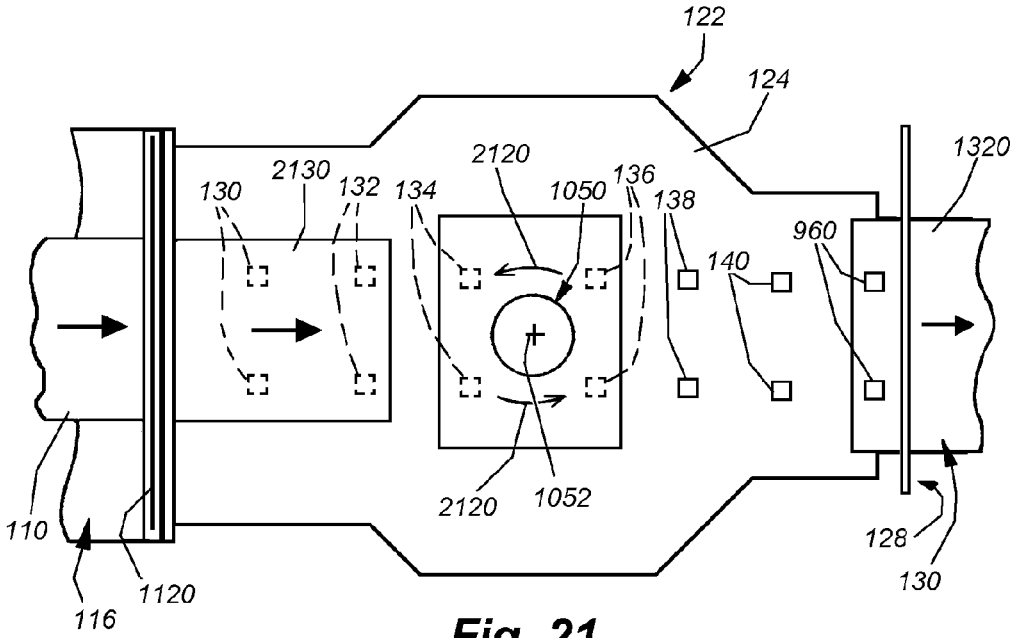
FIG. 21 is a partial top view of the sheet rotator feed table, adjacent upstream sheet cutter and downstream sheet utilization device of FIG. 1, in which the next curt and fed sheet is rotated approximately ninety degrees by the rotator disk assembly, while the downstream sheet is driven in to the utilization device and the upstream end of the web is separated to form an upstream sheet, in accordance with the first feed mode.
Figure 22:
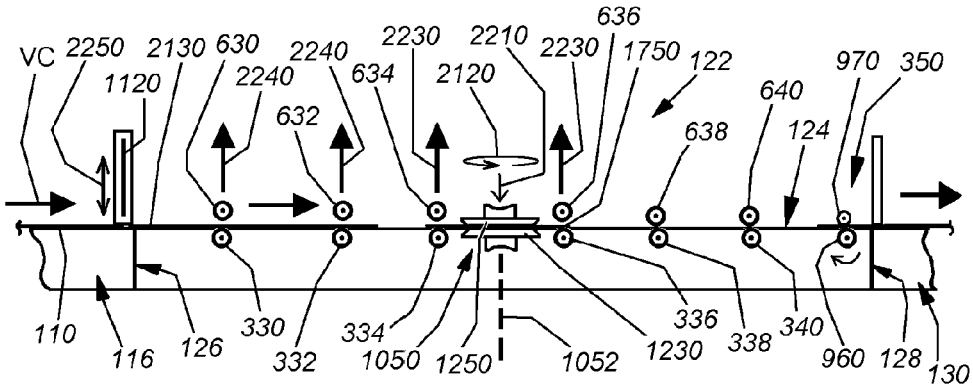
FIG. 22 is a partial side view of the arrangement of FIG. 21.

In FIGS. 21 and 22, the pressure disk 1250 is again lowered (arrow 2210), and the next sheet 1750 is rotated (curved arrows 2120) after the nips 634 and 636 are raised (arrows 2230) out of an interfering position. As shown, the downstream-most sheet 1320 has passed almost fully into the utilization device 130 at this time, while a new upstream sheet 2130 has been separated from the web end 110 by the cutter blade 1120. The nips 630 and 632 are raised (arrows 2240) while the new web end is directed downstream at the cutter rate (arrow VC). At the appropriate time, the cutter blade 1120 operates (double arrow 2250) as shown to separate the new sheet 2130. In this mode, accommodating sheet with length of up to approximately fourteen inches, at least three sheets can reside on the table 124 at one time, each being in a different state of handling/feeding. That is, one sheet is being fed into utilization device 130 while another sheet is rotated and a third sheet is being cut from the continuous web end. The speed of the various drives and timing of operation thereof, as well as the operation of actuatable nips and rotator disk assembly are determined so that each sheet will not overlap another on the table 124 during the process, and the sheets transition smoothly between a cut stage, a rotation stage and an outfeed stage. The system's console can provide the user the ability to set the particular size and width of sheets, which allows the controller to set the appropriate delay times between movement operations, as well as the feed speed utilized. Each new feed cycle of a sheet onto the table can be initiated by, for example, a print request signal issued by the utilization device 130. The process according the above-described first mode of operation continues until all requested sheets have been fed along the table. After such time, the cutter 116 ceases feeding sheets, and the last cut sheet and all downstream sheets remain in the queue on the table. In this manner, as soon as the next sheet request is issued by the printer, a sheet on the table is ready for immediate feeding downstream through the outfeed roller assembly 350, and into the feed port of the utilization device 130 with the need to re-queue the sheets on the table. If the requested sheets for the next job are of a different size than those of the last job, then the controller signals the user via the console to remove the improperly sized, queued-up sheets from the table so that the newly sized sheets can be initialized. The improperly sized sheets are removed by opening the cover assembly and physically removing the sheets. Note that in alternate embodiments, the table can be emptied by feeding only sheets that are requested and allowing the last sheet to enter the feed port of the utilization device with an otherwise clear table.

B. Mode 2

Figure 23:
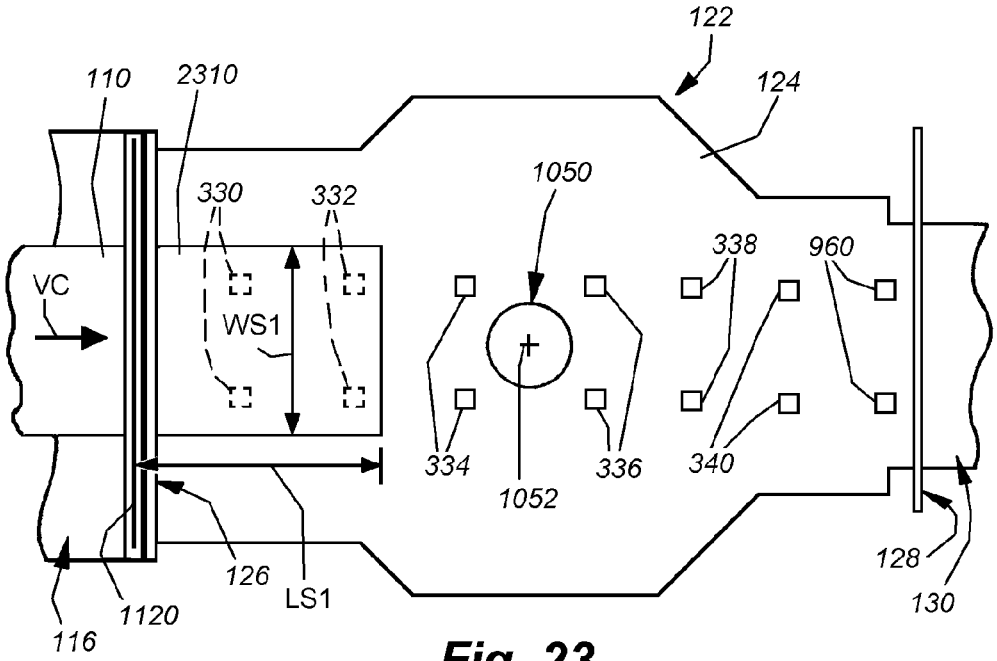
FIG. 23 is a partial top view of the sheet rotator feed table, adjacent upstream sheet cutter and downstream sheet utilization device of FIG. 1, in which a downstream end of a continuous web is driven from a cutter and separated into a small-sized sheet on the rotator according to a second feed mode.
Figure 24:
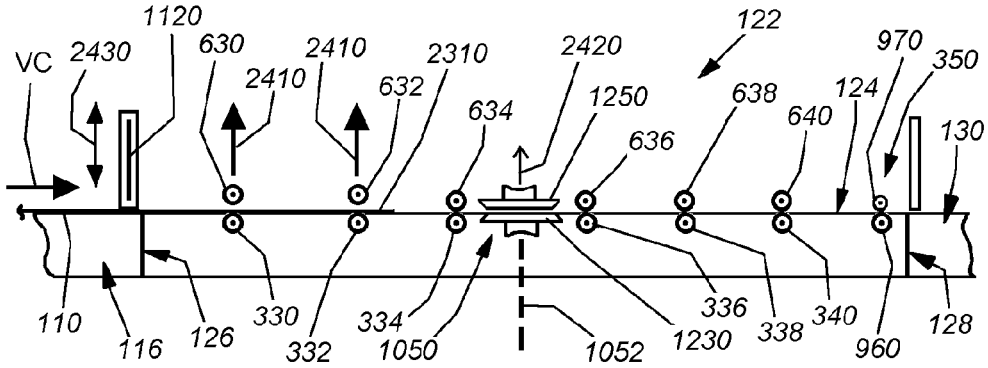
FIG. 24 is a partial side view of the arrangement of FIG. 27.

According to a second mode of operation, detailed in FIGS. 23-30, relatively short-length and width sheets (e.g. above-described length range LS1 and width range WS1) can be fed without rotation in a manner that is now described. Note that the length and width dimensions can be interchanged (e.g. feeding the shorter dimension in the upstream-to-downstream direction from the cutter in accordance with this mode). With reference to FIG. 23, a print request signal has been initiated by the utilization device 130, causing the cutter 116 to deliver a first sheet 2310 at a cutter feed rate VC to the table 124, and cut the sheet (double arrow 2430). The nips 630 and 632 are raised (arrows 2410) to accommodate the cutter feed rate VC as the web end is driven onto the feed table 124 for cutting. The rotator disk assembly's pressure disk 1250 is maintained in a raised position (arrow 2420) so as to not interfere with the passage of sheets between the opposing driven and pressure disks 1230 and 1250.

Figure 25:
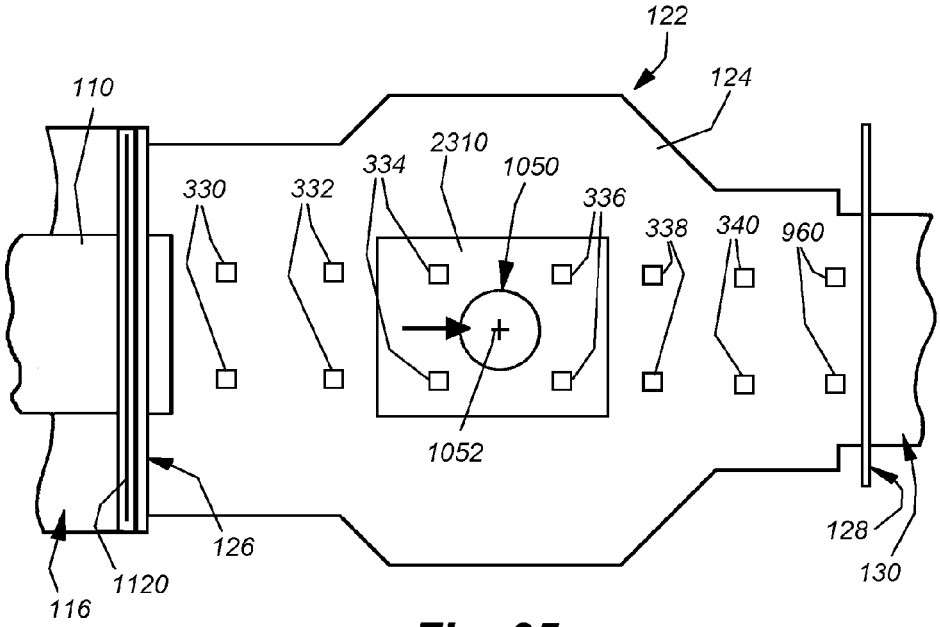
FIG. 25 is a partial top view of the sheet rotator feed table, adjacent upstream sheet cutter and downstream sheet utilization device of FIG. 1, in which the upstream sheet is driven into a centralized relationship with respect to the rotator disk assembly in accordance with the second feed mode.
Figure 26:
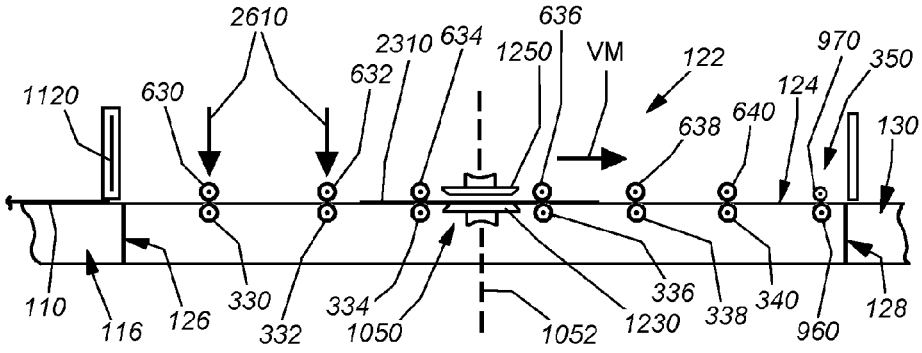
FIG. 26 is a side view of the arrangement of FIG. 25.

Next, according to FIGS. 25 and 26, the newly cut sheet 2310 is moved downstream at the rotator's feed rate (arrow VM) after the nips 630 and 632 are lowered (arrows 2610) to engage these drive elements. The rotator disk assembly's pressure disk 1250 is not lowered as no rotation is contemplated in this mode. Likewise, the nips 634 and 636 adjacent to the rotator disk assembly 1050 remain in engagement with the sheet 2310.

Figure 27:
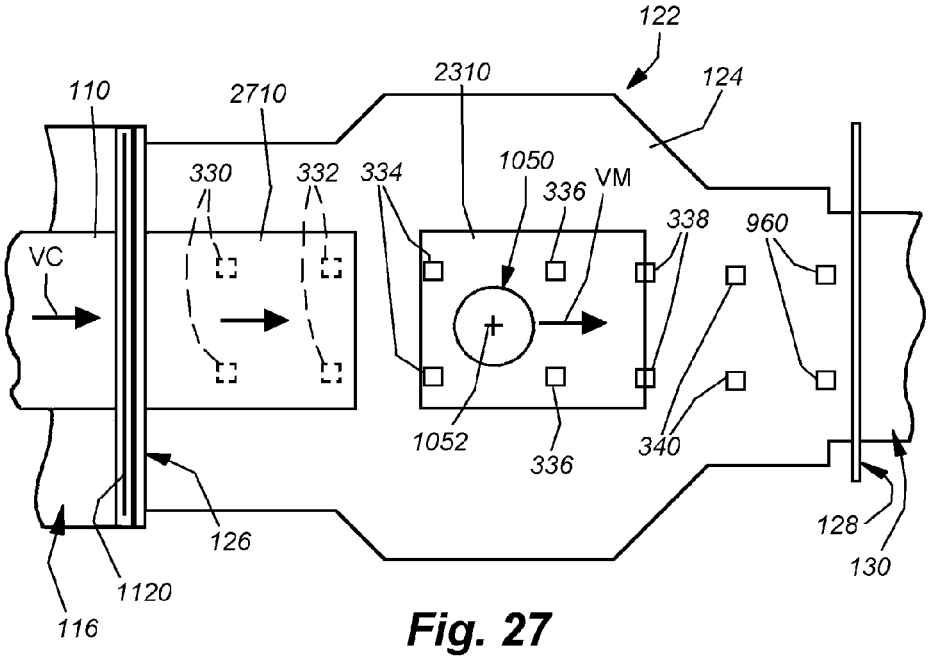
FIG. 27 is a partial top view of the sheet rotator feed table, adjacent upstream sheet cutter and downstream sheet utilization device of FIG. 1, in which the downstream sheet is driven from the rotator disk assembly, free of any rotation thereof, and an upstream sheet is formed from a downstream end of the web at the cutter in accordance with the second feed mode.
Figure 28:
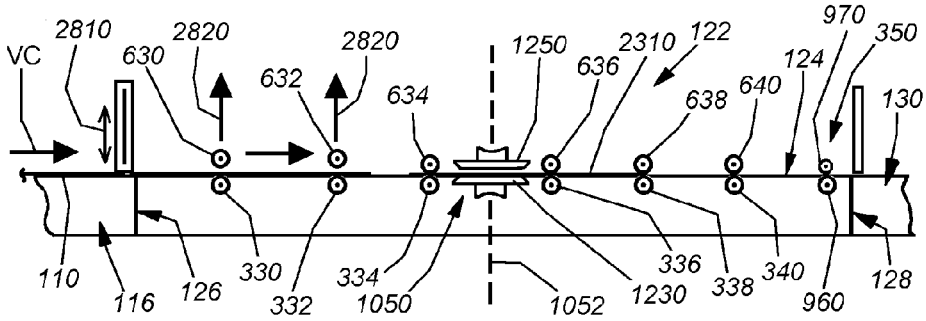
FIG. 28 is a partial side view of the arrangement of FIG. 27.

Next, according to FIGS. 27 and 28, the cutter 116 transports a new web end (arrow VC) onto the table 124, and the blade 1120 separates it (double arrow 2810) to define a new upstream sheet 2710. At the same time, the downstream sheet 2310 is transported by the nips 643, 636 and 638 toward the outfeed (arrow VM), as the new sheet 2710 is transported onto the table with the nips 630 and 632 raised (arrows 2820), in accordance with the procedures described above described above.

Figure 29:
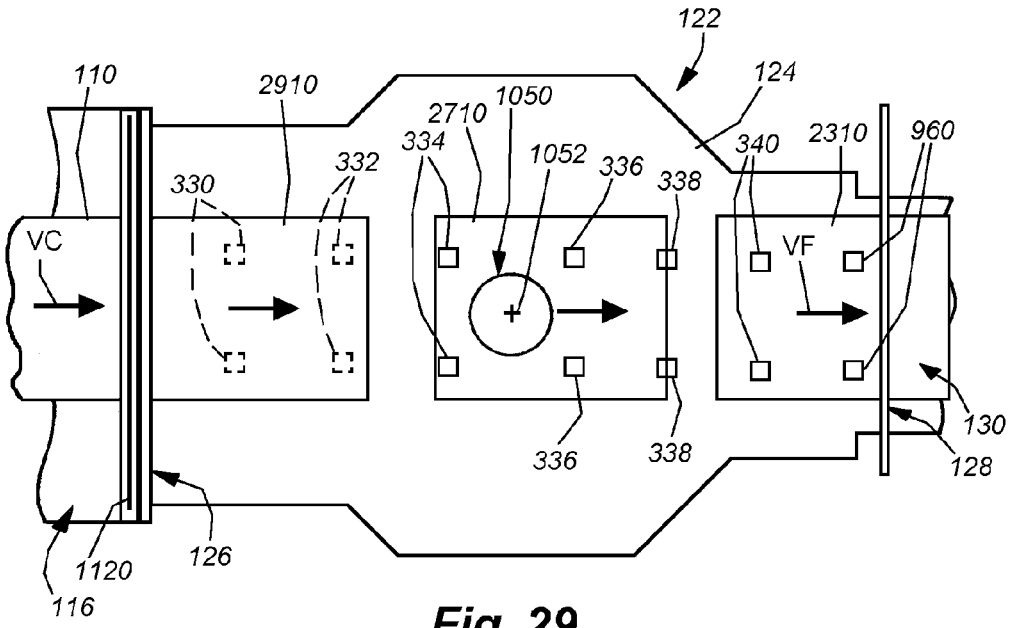
FIG. 29 is a partial top view of the sheet rotator feed table, adjacent upstream sheet cutter and downstream sheet utilization device of FIG. 1, in which the downstream sheet is driven into the utilization device while the upstream sheet is driven through the rotator disk assembly, free of rotation thereof, and an upstream sheet is formed by the cutter from a downstream end of the web in accordance with the second feed mode.
Figure 30:
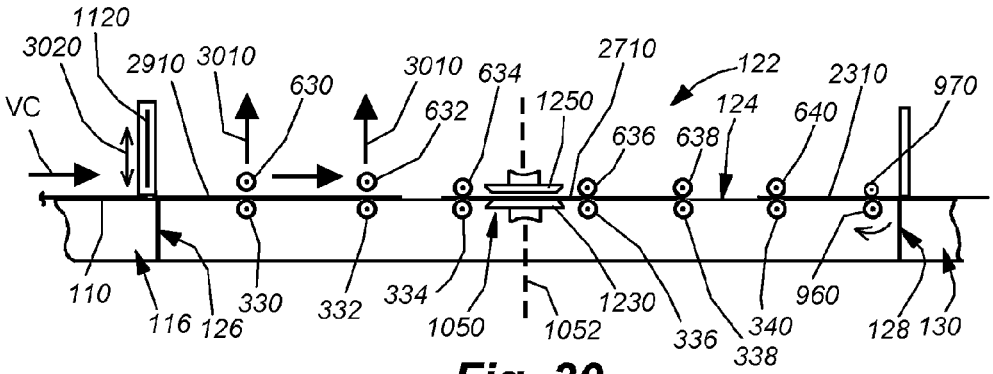
FIG. 30 is a side view of the arrangement of FIG. 29.

According to FIGS. 29 and 30, the downstream sheet 2310 is now transported at the outfeed feed rate (arrows VF) by the outfeed roller assembly 350 into the utilization device 130, while the upstream sheet 2710 is transported through the rotator disk assembly 1050 by nips 630, 632 (which were lowered as the sheet was cut), 634 and 636. After lowering, and feeding the sheet 2710 downstream, the nips 630 and 632 are again raised (arrows 3010) as shown to allow another sheet 2910 to be driven and cut (double arrow 3020) on the feed table 124. The process continues with the nips 630 and 632 being reengaged to direct the new sheet 2910 downstream to the center of the table 124, while the central sheet 2710 is eventually passed to the outfeed roller assembly 350. Where appropriate, the downstream nips 638 and 640 can be raised as the outfeed assembly engages the sheet 2310.

C. Mode 3

FIGS. 31-40 detail the feeding of sheets between the cutter 116 and the utilization device 130 according to a third mode of operation utilizing somewhat large sheets to be rotated. As shown, the exemplary web 110 is fed by the cutter 116 with a relatively wide end onto the table 124. In this feed and rotation mode, the sheets can have a length LS2 (upstream-to-downstream) in a range of between be approximately 10-14½ inches and a width WS2 (perpendicular to the upstream-to-downstream direction) of between approximately 11½-21 inches. Note that the length and width dimensions can be interchanged (e.g. feeding the longer dimension in the upstream-to-downstream direction from the cutter in accordance with this mode).

Figure 31:
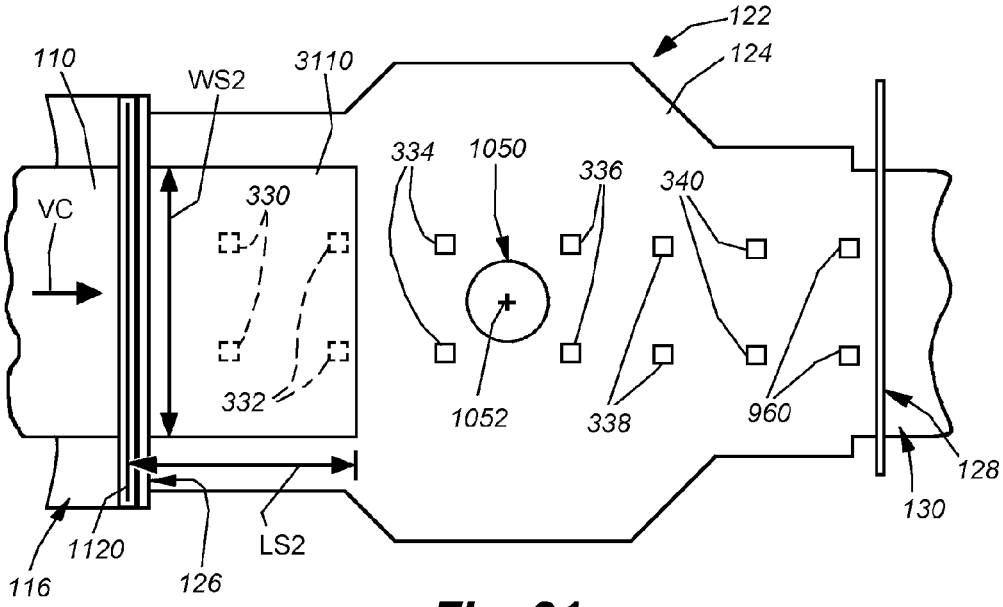
FIG. 31 is a partial top view of the sheet rotator feed table, adjacent upstream sheet cutter and downstream sheet utilization device of FIG. 1, in which a downstream end of the web is directed onto the rotator and cut by the cutter, the cut sheet being a larger-sized sheet in accordance with a third feed mode.
Figure 32:
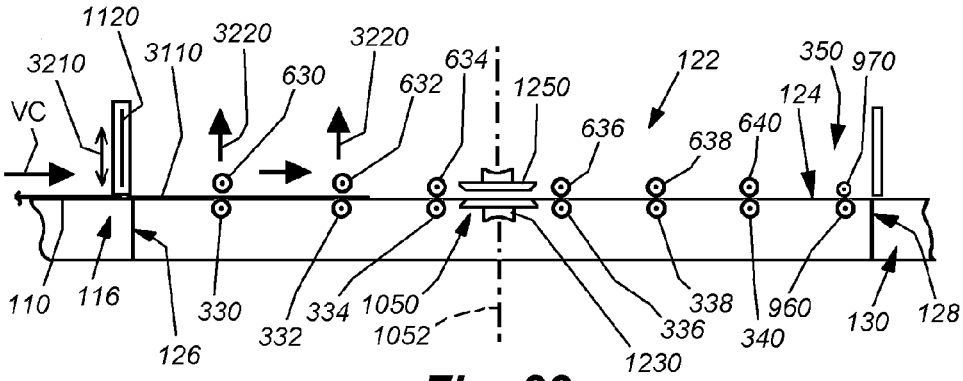
FIG. 32 is a partial side view arrangement of FIG. 31.

As shown in FIGS. 31-32, the cutter blade 1120 moves (double arrow 3210) to form the resulting upstream sheet 3110 form the web end as shown in FIGS. 31 and 32. Sheets are fed from the cutter 116 at the cutter feed rate (arrow VC) while nips 630 and 632 are raised (arrows 3220). For longer sheets, the third nip pair 634 may also be raised during feeding—and all nips 630, 632 (and 634) are subsequently lowered prior to cutting to maintain engagement on the resulting sheet.

Figure 33:
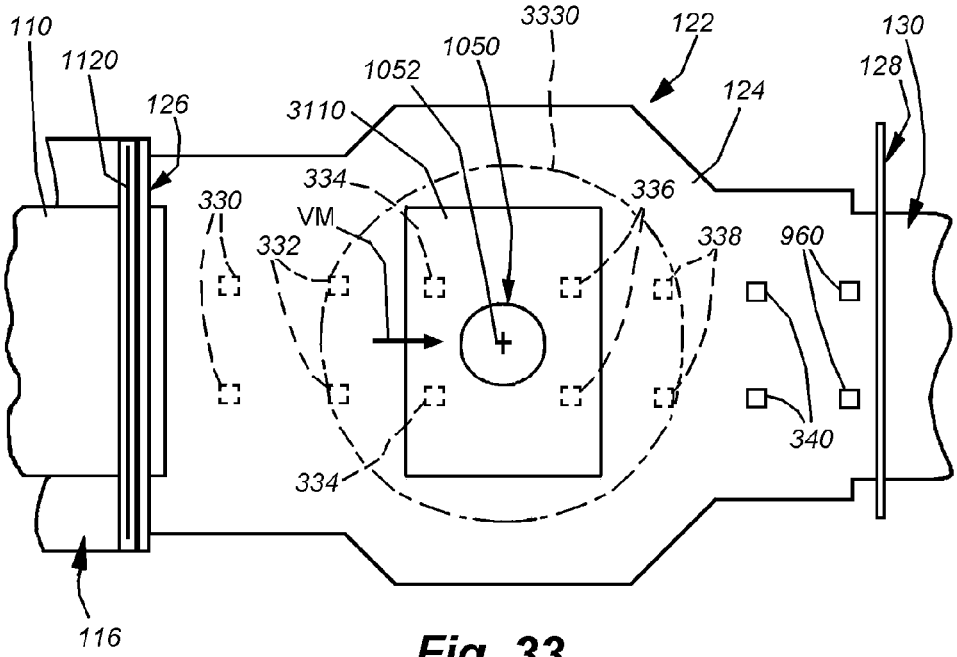
FIG. 33 is a partial top view of the sheet rotator feed table, adjacent upstream sheet cutter and downstream sheet utilization device of FIG. 1, in which the upstream sheet is directed to a centralized location with respect to the rotator disk assembly.
Figure 34:
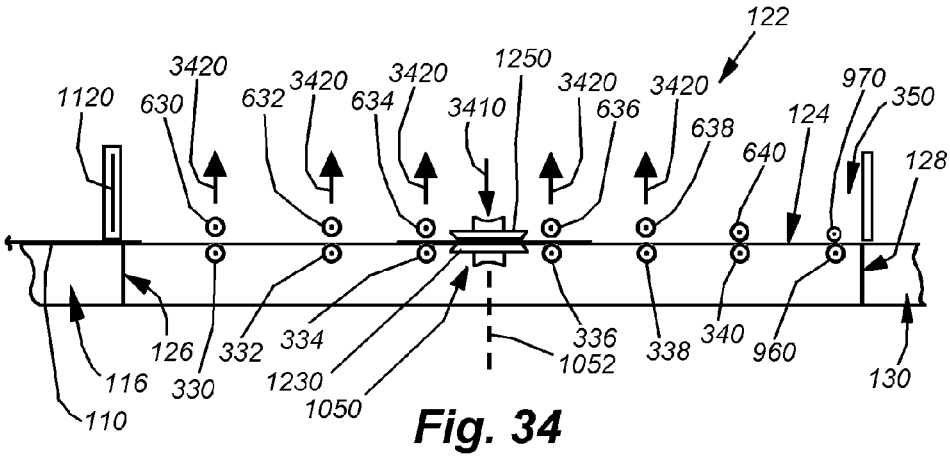
FIG. 34 is a partial side view of the arrangement of FIG. 33.
Figure 35:
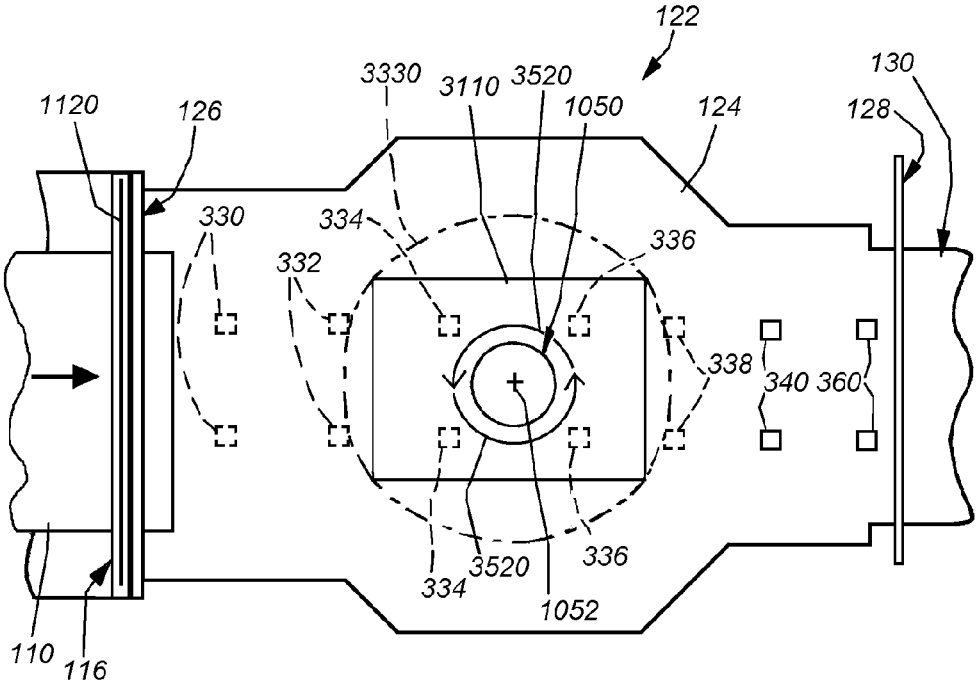
FIG. 35 is a is a partial top view of the sheet rotator feed table, adjacent upstream sheet cutter and downstream sheet utilization device of FIG. 1, in which the sheet is rotated approximately ninety degrees so that its elongated dimension is orientated in the upstream-to-downstream direction and a new leading end of the web is directed through the cutter onto the rotator to form a new upstream sheet in accordance with a third feed mode.

With further reference to FIGS. 33 and 34, the nips 630 and 632, which were initially lowered (not shown) to drive the newly cut sheet 3110 into a central position with respect to the rotator disk assembly 1050 (arrow VM) are again raised. That is, once the sheet 3110 is centered with respect to the rotator disk assembly 1050, the pressure disk 1230 engages the sheet 3110 as shown. The nips, 632, 634, 636 and 638 are then all raised (arrows 3420). As shown particularly in FIG. 33, the rotation radius of the sheet, as depicted by the dashed circled 3330 is quite large, and thus passes into the region of the upstream and downstream roller pairs 332 and 338 (and corresponding nips 632 and 638), requiring these nips to be raised—i.e. not only must the nips 634 and 636 be raised, but also the nips 632 and 638 to prevent interference with rotation of the sheet 3110.

Figure 36:
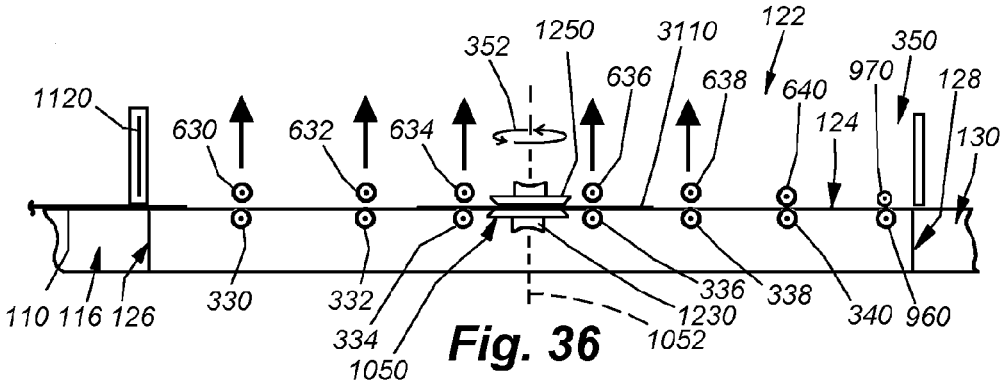
FIG. 36 is a partial side view of the arrangement of FIG. 35.

As now shown in FIGS. 36 and 36, the sheet 3110 is rotated, (curved arrows 3520) by the rotator disk assembly 1050. Note that a new sheet has not yet been driven by the cutter by the upstream, web as the nips cannot yet engage it while providing rotation clearance for the sheet 3110.

Figure 37:
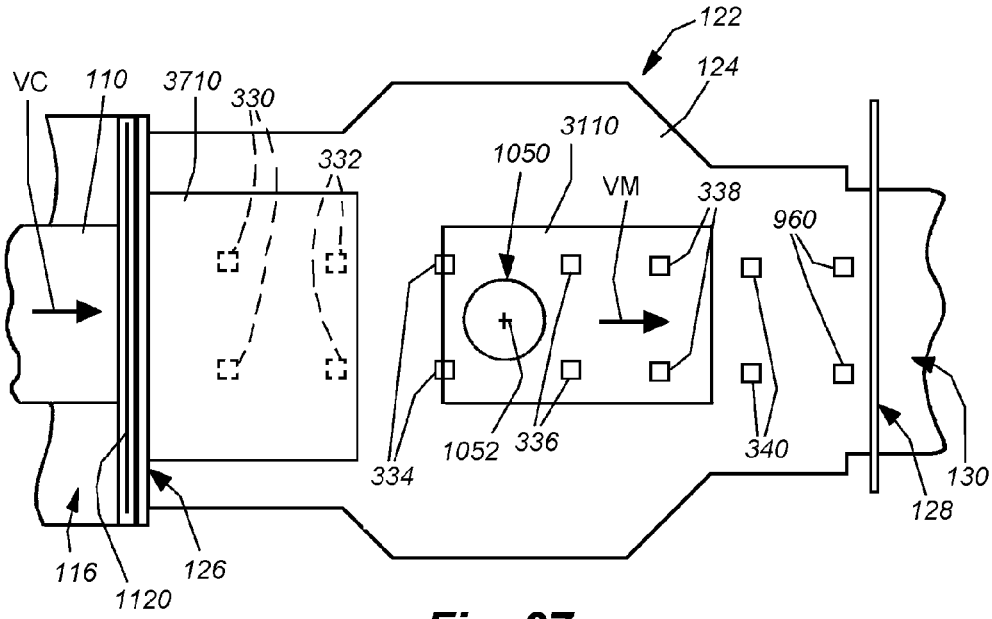
FIG. 37 is a partial top view of the sheet rotator feed table, adjacent upstream sheet cutter and downstream sheet utilization device of FIG. 1, in which the downstream sheet is directed away from the rotator disk assembly while the upstream sheet is separated and formed by the cutter from the downstream end of the web in accordance with the third feed mode.
Figure 38:
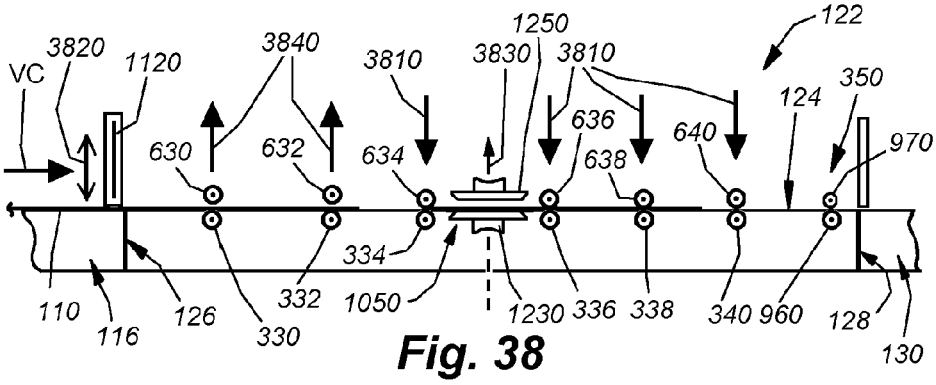
FIG. 38 is a partial side view of the arrangement of FIG. 37.

Next, as shown in FIGS. 37 and 38, the nips 634, 636, 638 and 640 are again lowered (arrows 3810) and the pressure disk 1250 is then raised (arrow 3830) to allow downstream movement (arrow VM) of the sheet toward the outfeed roller assembly 350. Since room is available on the feed table 124, and the nips 330, 334 and 338 can be freed to properly engage it, a new sheet 3710 is now driven (cutter arrow VC) by the cutter 116 onto the table, and separated (double arrow 3820) by the cutter blade 1120. The nips 630 and 632 are raised (arrows 3840) to allow entrance of this new upstream sheet 3710. Subsequently, the nips 630 and 632 will be lowered to drive the sheet into the rotator disk assembly 1050.

Figure 39:
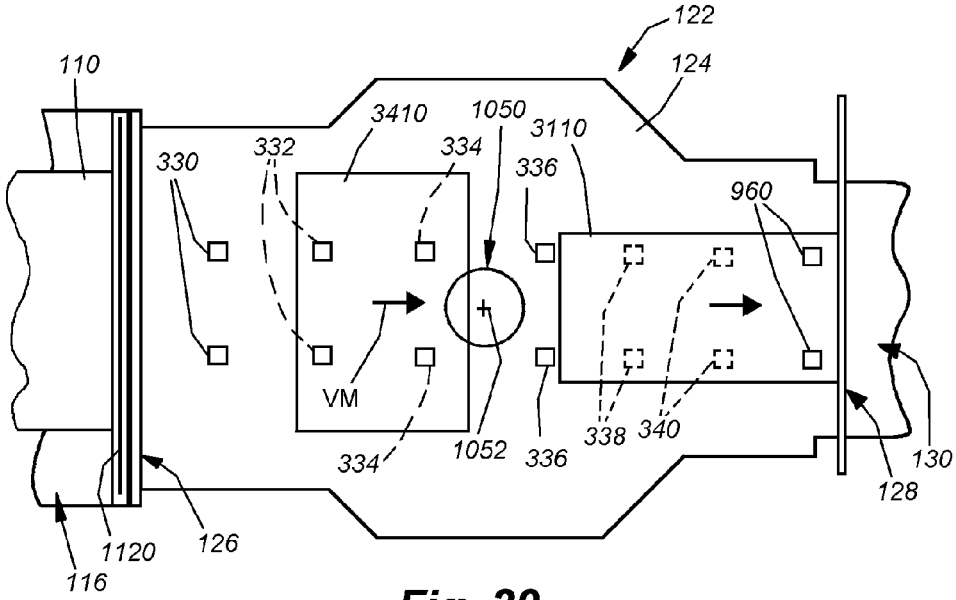
FIG. 39 is a partial top view of the sheet rotator feed table, adjacent upstream sheet cutter and downstream sheet utilization device of FIG. 1, in which the new upstream sheet is driven toward the rotator disk assembly, and the downstream sheet is directed into the utilization device in accordance with the third feed mode.
Figure 40:
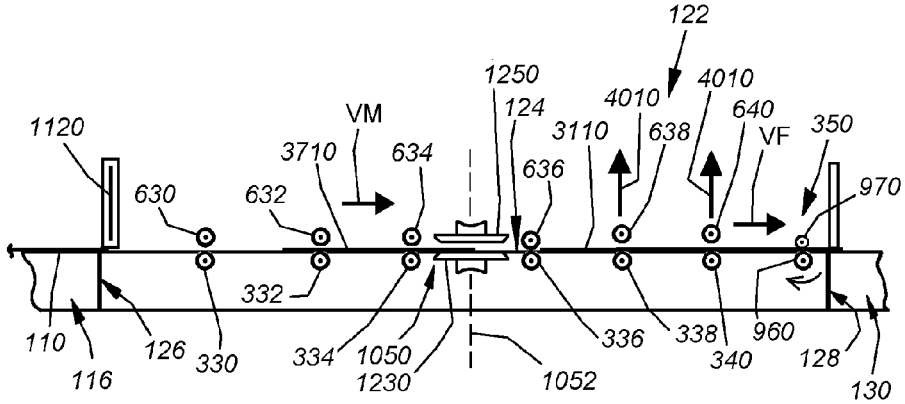
FIG. 40 is a partial side view of the arrangement of FIG. 39.

As now shown in FIGS. 39 and 40, the sheet 3110 has been engaged by the outfeed roller assembly 350, and is being driven into the utilization device 130. The upstream nips 638 and 640 may be raised (arrows 4010) at this time to allow conformance to the utilization device's feed rate—which would not necessarily match the rotator drive rate VM. The next upstream sheet 3710 is being directed (arrow VM) to the raised rotator disk assembly 1050 by the lowered nips 630, 632, and 634. The outfeed velocity (arrow VF), and timing are sufficient to ensure that the sheet 3110 substantially exits from the table before the upstream sheet 3710 becomes centered upon the rotator disk assembly 1050. Then, after the upstream sheet 3710 enters the rotator disk assembly, the pressure disk 1250 is lowered and the nips 630, 632, 634, 636 and 638 are then raised to allow unimpeded rotation of the sheet 3710. After rotation, these nips are again lowered to drive the sheet 3710 further downstream.

D. Mode 4

The feeding of sheets according to a fourth mode of operation is now described with reference to FIGS. 41-48. In this mode, the sheets define larger dimensions and are unrotated. For example, the sheet (sheet 4310 in FIG. 43) formed from the web end in FIG. 41 can define an upstream-to-downstream length LS3 of between approximately 11½ and 17 inches and a width WS3 of approximately 10-14 inches. In this mode, such long sheets will be fed without rotation.

Figure 41:
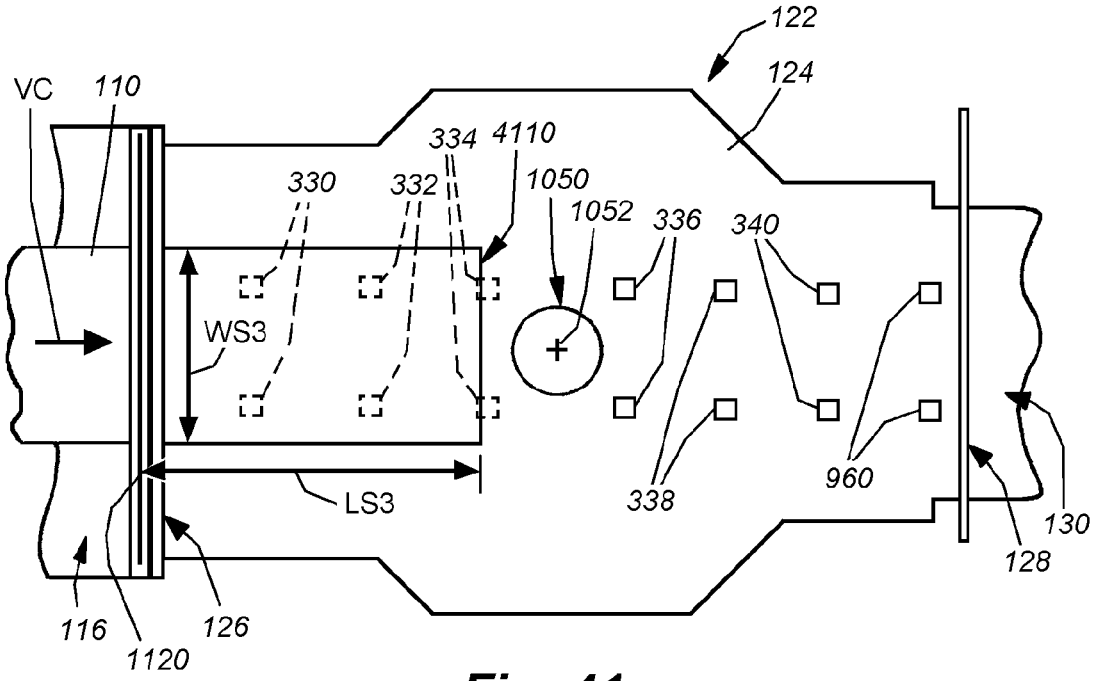
FIG. 41 is a partial top view of the sheet rotator feed table, adjacent upstream sheet cutter and downstream sheet utilization device of FIG. 1, in which the downstream end of the web is delivered from the cutter to form a larger-sized sheet according to a fourth feed mode.
Figure 42:
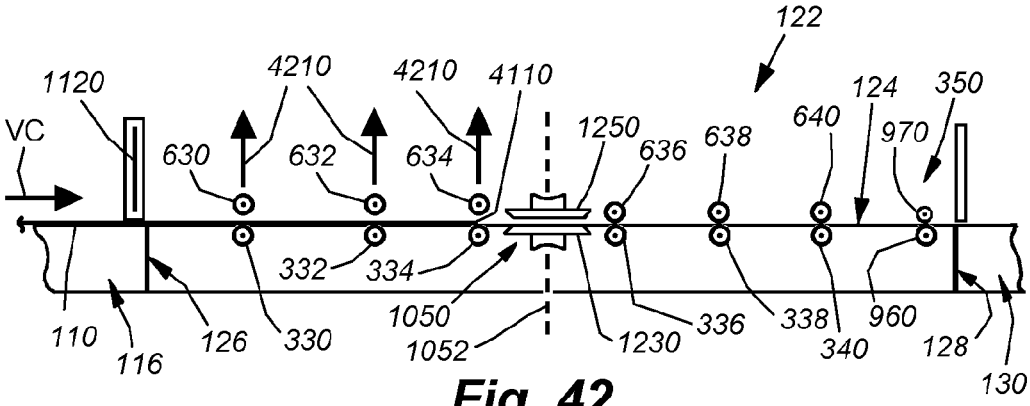
FIG. 42 is a side perspective view of the arrangement of FIG. 41.

As shown in FIGS. 41-42, the cutter 116 initially feeds a downstream web end to the feed table 124 at the cutter velocity (arrow VC) based upon a print request signal. Note that the web end's downstream edge 4110 extends to approximately the third set of rollers 334, defining this as a relatively long sheet when cut. At this time, the nips 630, 632 and 634 are raised (arrows 4210) to accommodate the feeding of the web end by the cutter 116.

Figure 43:
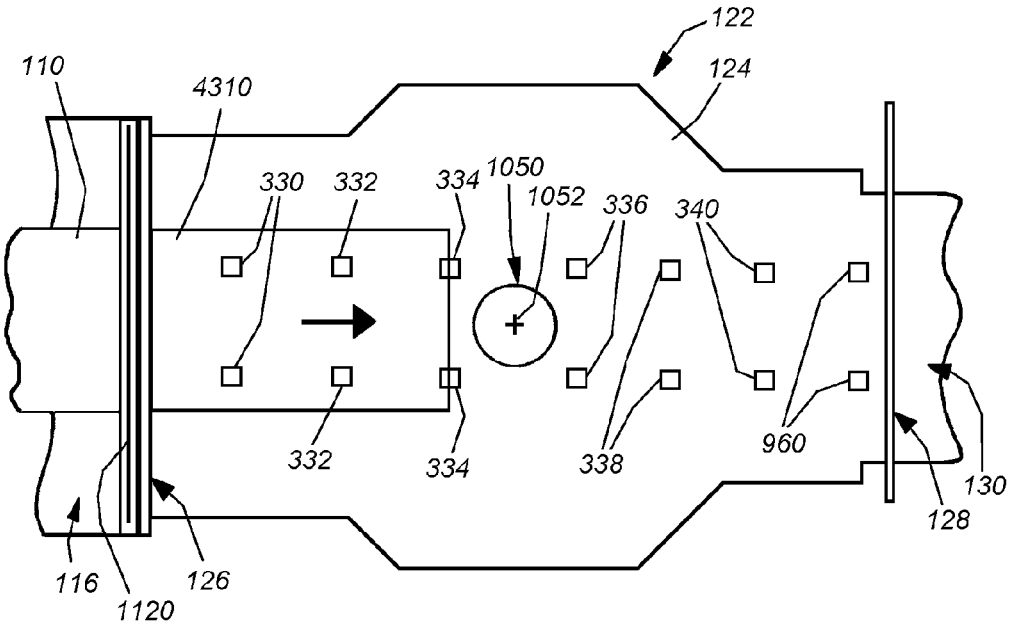
FIG. 43 is a partial top view of the sheet rotator feed table, adjacent upstream sheet cutter and downstream sheet utilization device of FIG. 1, in which the downstream end of the web is cut into the upstream sheet at the upstream end of the rotator in accordance with the fourth feed mode.
Figure 44:
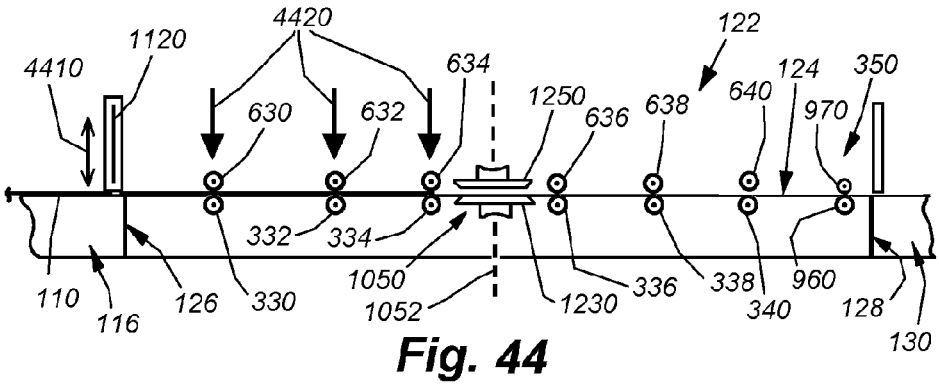
FIG. 44 is a partial side view of the arrangement of FIG. 43.

Next, as shown in FIGS. 43 and 44, the cutter blade 1120 operates (double arrow 4410) to separate the web end into the sheet 4310. The nips 630, 632 and 634 are lowered (arrows 4420) prior to the cut to allow engagement of, and downstream driving of, the sheet 4310. Since rotation will not be undertaken, the pressure plate 1250 of the rotator disk assembly remains in an upward position during the entire process of feeding by the rotator 122.

Figure 45:
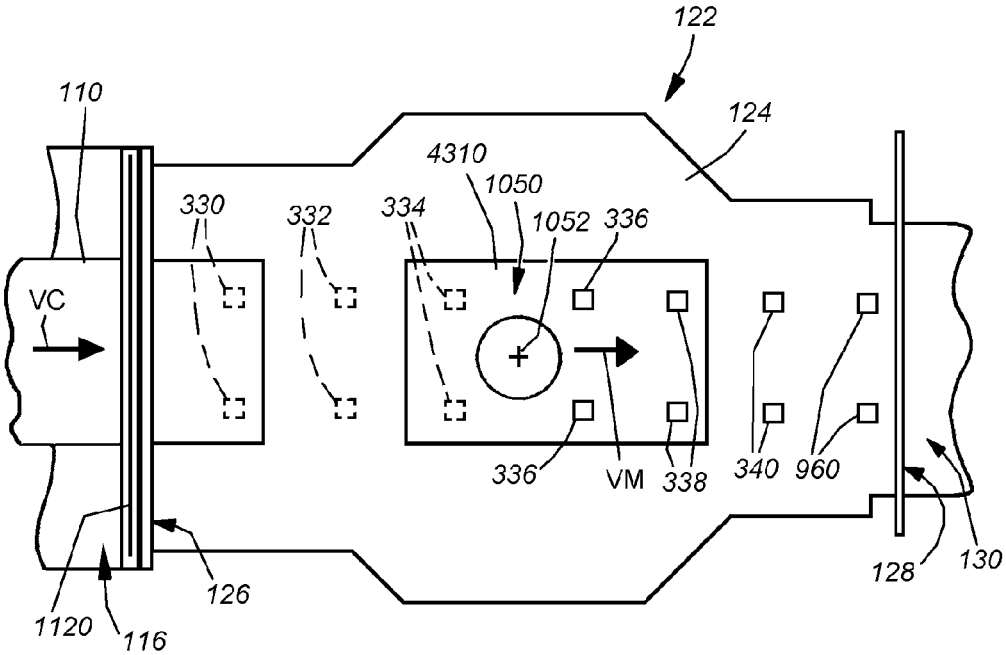
FIG. 45 is a partial top view of the sheet rotator feed table, adjacent upstream sheet cutter and downstream sheet utilization device of FIG. 1, in which the downstream sheet is directed through the rotator disk assembly, free of any rotation, while an upstream end of the web is directed onto the upstream portion of the rotator to form a new upstream sheet in accordance with the fourth feed mode.
Figure 46:
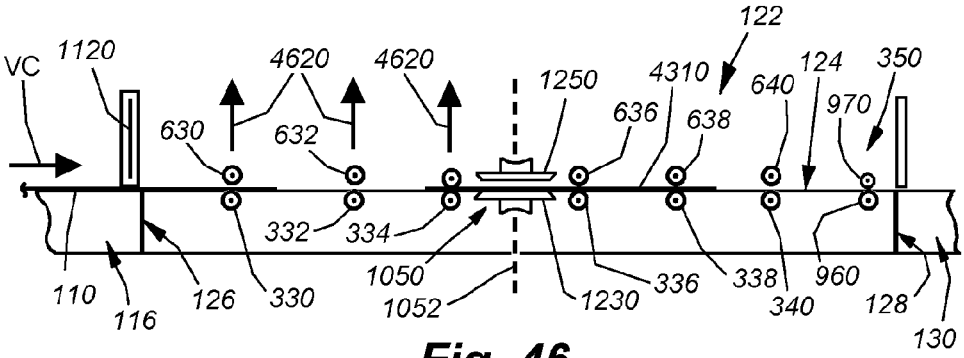
FIG. 46 is a partial side view of the arrangement of FIG. 45.

Next, according to FIGS. 45 and 46, the nips 630, 632 and 634 have already driven the sheet partially downstream through the rotator disk assembly 1050. At the appropriate time, the cutter 116 delivers a new web end at the cutter velocity (arrow VC) to the table 124. Nips 630, 632, and 634 are raised (arrows 4620) to accommodate entrance of the new sheet. At the same time, the downstream sheet 4310 is being moved further downstream (arrow VM) and is grasped by the downstream nips 636, 688, and eventually, 640. At any time, at least one nip pair (and generally more pairs) engage the sheet 4310. The timing of the system is such that appropriate nips are raised as needed, and lowered as needed, based upon the timing profile of the particular sheet width, length and whether or not it will be rotated. One of ordinary skill should be able to determine when the timing is appropriate to raise and lower nips and rotator elements based upon the layout of elements, their spacing, the response time of the various actuators, and the velocity of the various drive motors.

Figure 47:
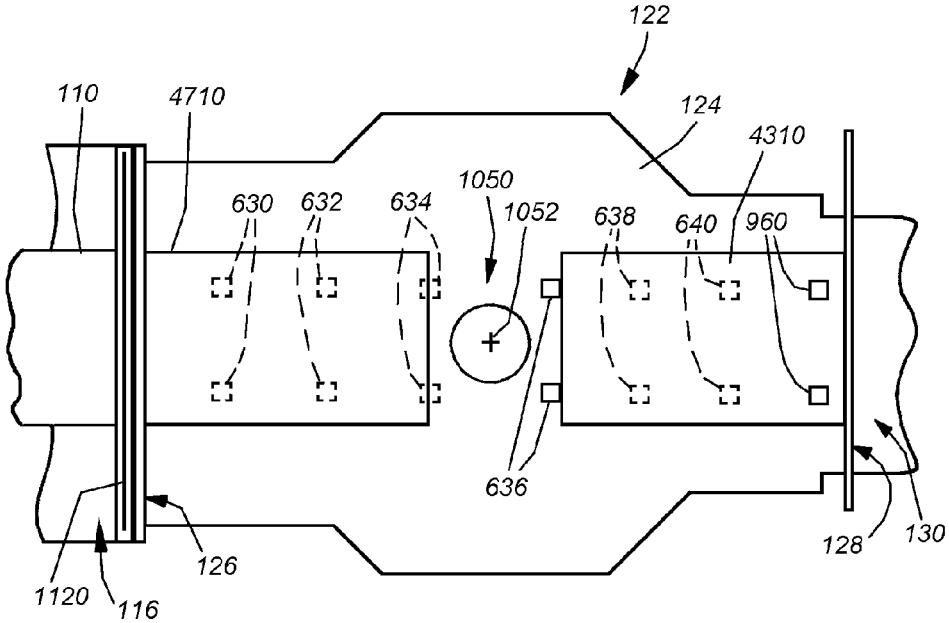
FIG. 47 is a partial top view of the sheet rotator feed table, adjacent upstream sheet cutter and downstream sheet utilization device of FIG. 1, in which the downstream sheet is driven through the rotator disk assembly, free of rotation, and into the utilization device, while the upstream end of the web is cut into a new upstream sheet on the upstream end of the rotator in accordance with the fourth feed mode.
Figure 48:
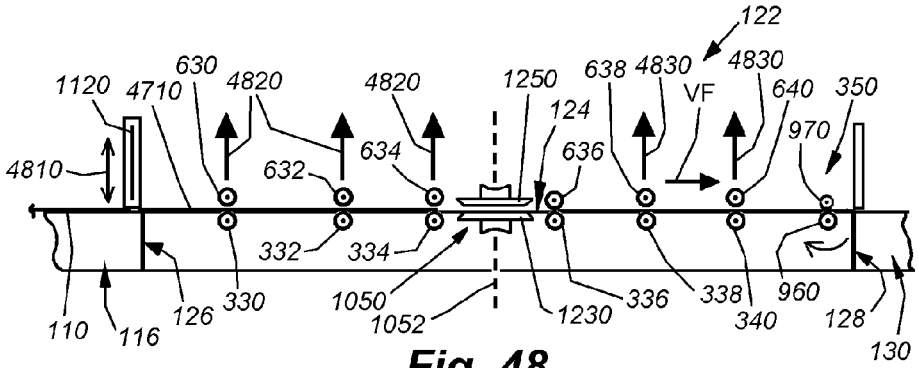
FIG. 48 is a partial side view of the arrangement of FIG. 47.

According to FIGS. 47 and 48, the new upstream sheet 4710 is formed by movement of the cutter blade 1120 (double arrow 4810), while the nips 630, 632 and 634 remain raised (arrows 4820). The downstream sheet 4310 has become engaged by the outfeed roller assembly 350, and is being driven an outfeed rate VF into the utilization device 130. The nips 638 and 640 may be raised (arrows 4830) at this time to facilitate driving of the sheet 4310 at the differentiated outfeed rate VF. After the sheet 4310 has provided sufficient clearance on the feed table 124, the nips 630, 632 and 634 are again lowered to drive the newly cut upstream sheet 4710 in the downstream direction across the table, and into the outfeed section.

As described above, feeding (and rotating) sheets through the rotator 122 in accordance with Mode 3 and Mode 4 is generally characterized by the presence of a maximum of two sheets on the feed table in any cycle. This differs from Modes 1 and 2 wherein the table can accommodate as many as three sheets.

E. Mode 5

Figure 49:
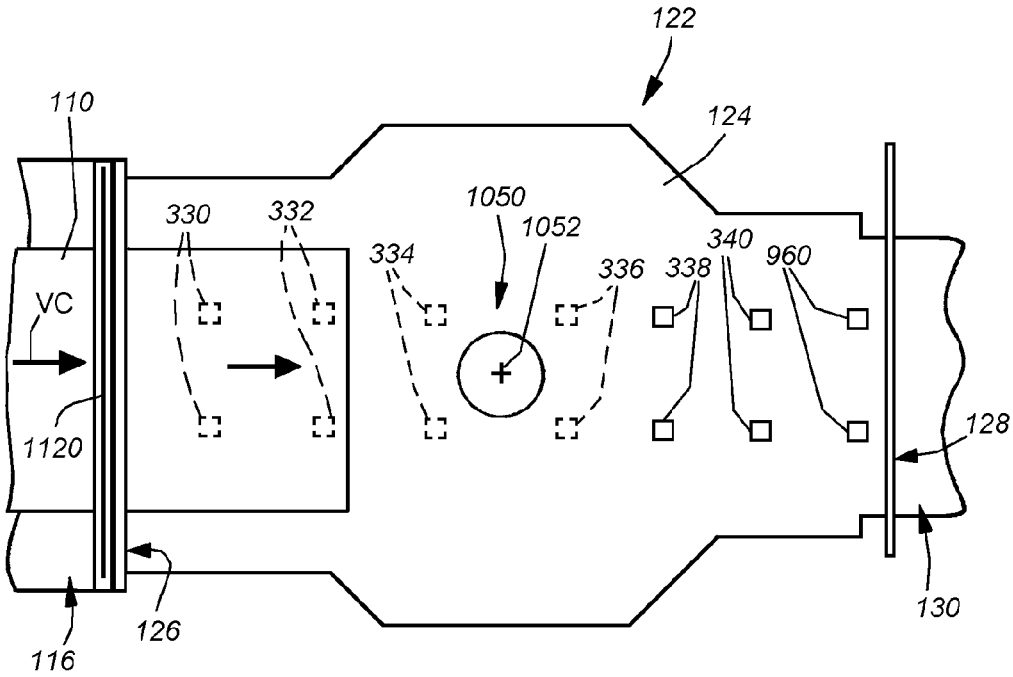
FIG. 49 is a partial top view of the sheet rotator feed table, adjacent upstream sheet cutter and downstream sheet utilization device of FIG. 1, in which the downstream end of a wide and long web section is directed onto the upstream end of the rotator so as to cut and form a sheet that exceeds the maximum dimension that can be rotated by the rotator disk assembly of the rotator in accordance with a fifth feed mode.
Figure 50:
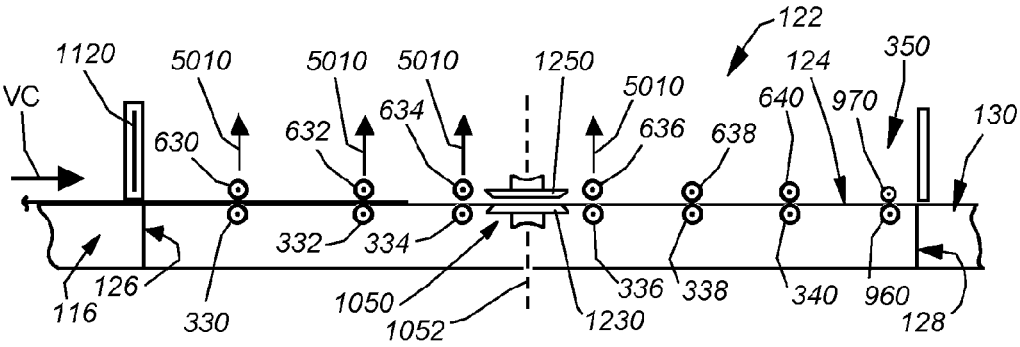
FIG. 50 is a partial side view of the arrangement of FIG. 53.
Figure 51:
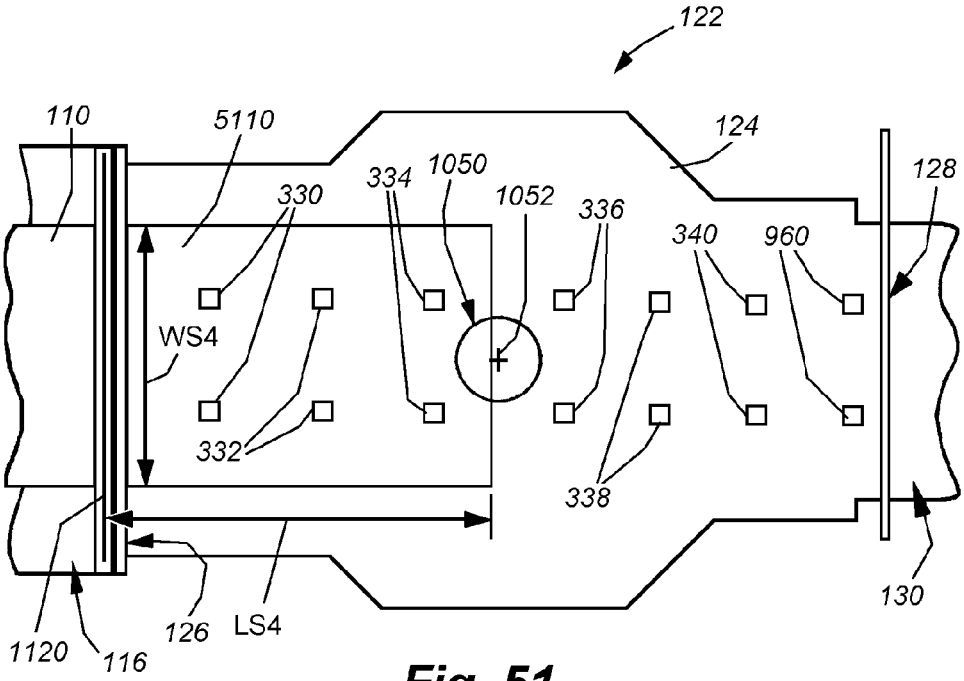
FIG. 51 is a partial top view of the sheet rotator feed table, adjacent upstream sheet cutter and downstream sheet utilization device of FIG. 1, in which an upstream sheet is cut and formed by the cutter in a manner that partially overlies the rotator disk assembly in accordance with the fifth feed mode.

FIGS. 49-56 depict a fifth mode of feed operation using the rotator 122 of this illustrative embodiment in which the cut sheets define a rotation radius that may be too large to be rotate and, thus, are fed directly through the sheet rotator 122 to the outfeed table free of any rotation. In this mode, effectively only one sheet traverses the feed table 124 of the rotator 122 in a cycle. For example, as shown in FIG. 51, the sheet (5110) has an upstream-to downstream length LS4 of approximately 17-22½ inches (22½ inches being the maximum size in this embodiment) and a width WS4 of approximately 10-14½ inches.

As shown in FIGS. 49 and 50, the downstream end of the web 110 is driven by the cutter 116 onto the feed table 124.

While being driven, the nips 630, 632, 634 and 636 are each raised upwardly (arrows 5010) to accommodate the cutter feed rate. The sheet to be cut in this example can have a maximum length of approximately 22½ inches in a downstream direction, and a width of, for example, 14 inches.

Figure 52:
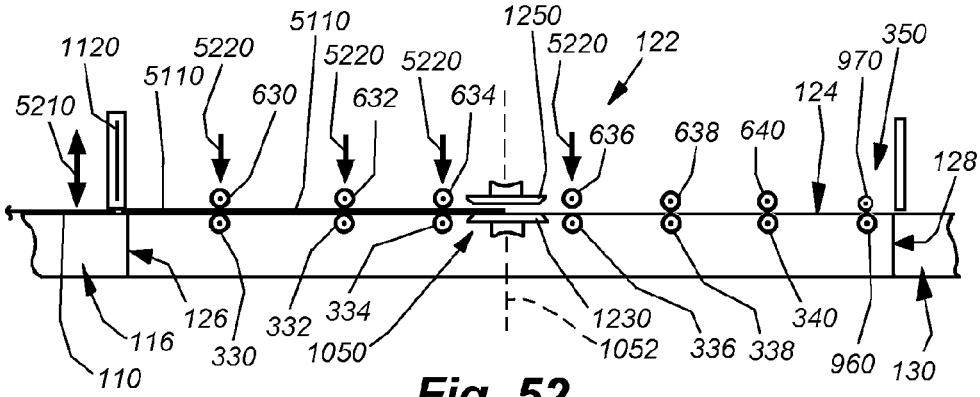
FIG. 52 is a partial side view of the arrangement of FIG. 51.

Next, as shown in FIGS. 51 and 52, once the web 110 has been driven fully onto the feed table 124, the cutting blade 1120 is operated (double arrow 5210) to form the sheet 5110. The nips 630, 632, 634 and 636 are lowered (arrows 5220) to begin driving the sheet 5110 in the downstream direction.

Figure 53:
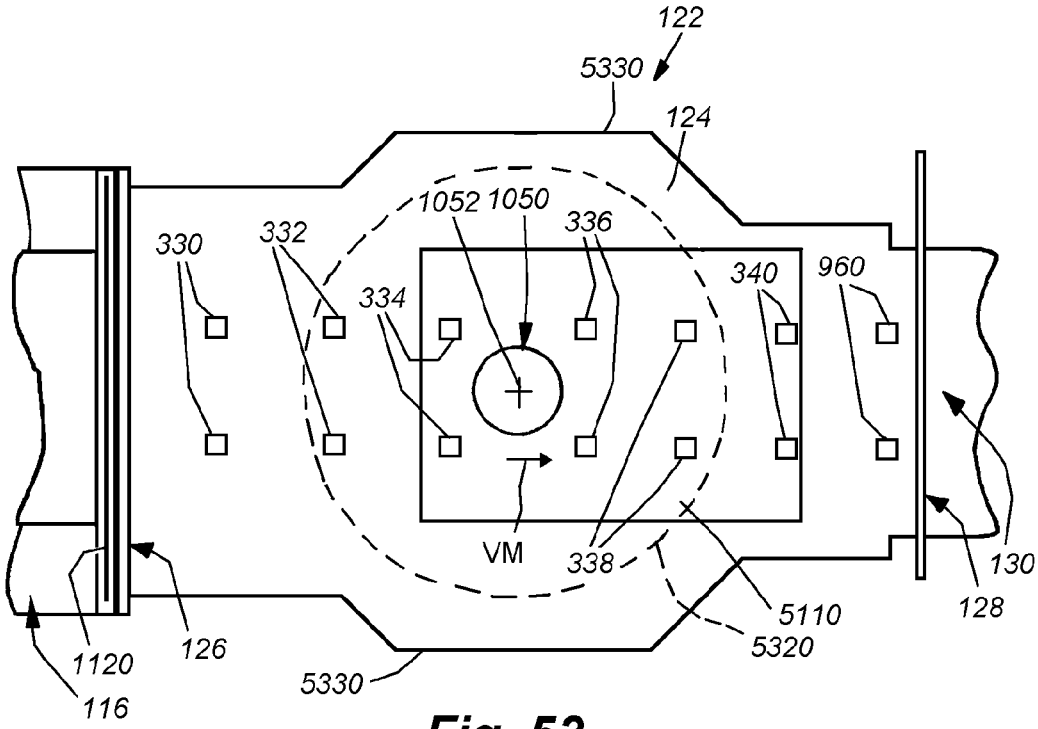
FIG. 53 is a partial top view of the sheet rotator feed table, adjacent upstream sheet cutter and downstream sheet utilization device of FIG. 1, in which the sheet passes through the rotator disk assembly, free of any rotation, and is directed toward the utilization device in accordance with the fifth feed mode.
Figure 54:
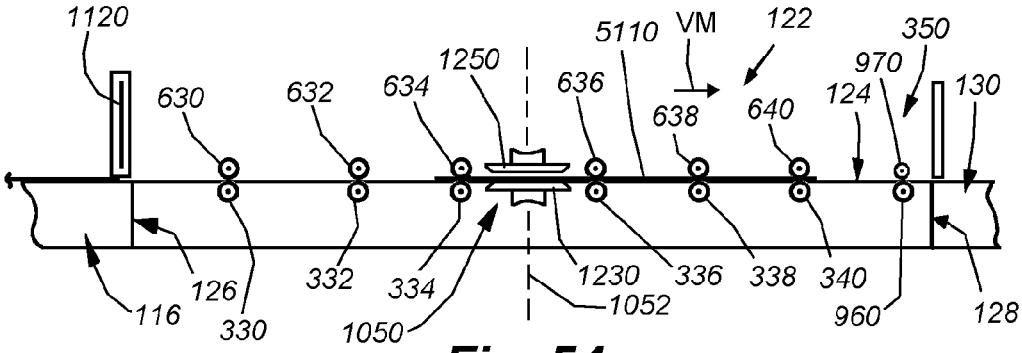
FIG. 54 is a partial side view of the arrangement of FIG. 53.

The driving of the sheet 5110 is shown in further detail in FIGS. 53 and 54 in which the sheet 5110 is driven (arrow VM) downstream toward the outfeed roller assembly 350. Note that the effective rotation radius, depicted by the dashed circle 5320 extends near to, or beyond, the outer edges 5330 of the table 124 at the rotation section. Thus, the sheet 5110 cannot be rotated by this version of the rotator 122. Nevertheless, it can be fed in a direct line in accordance with the operation of Mode 5. The pressure disk 1250 of the rotator disk assembly 1050 remains in an upward position throughout operation in this mode.

Figure 55:
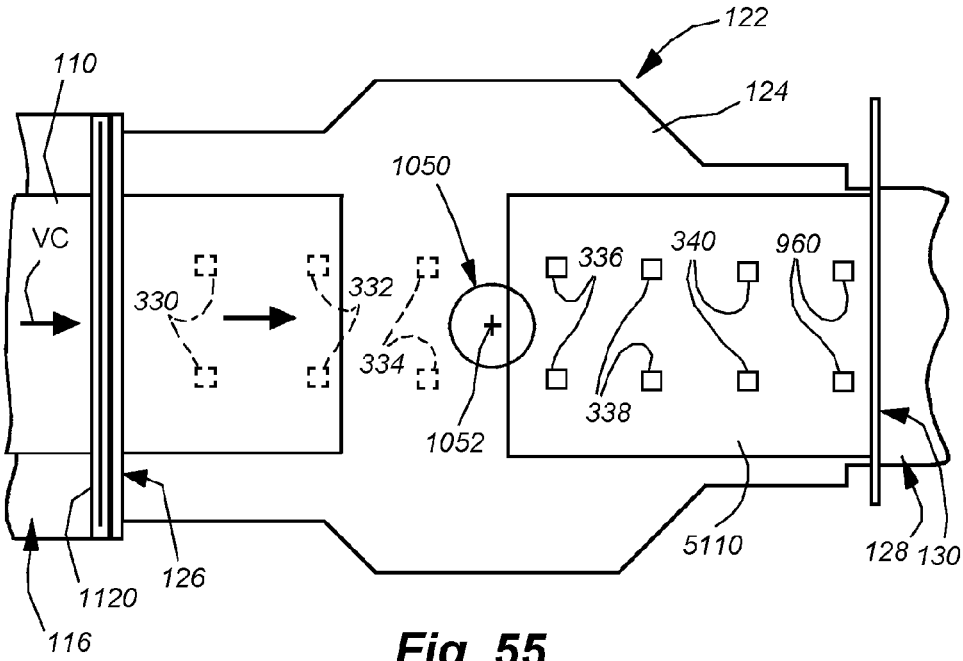
FIG. 55 is a partial top view of the sheet rotator feed table, adjacent upstream sheet cutter and downstream sheet utilization device of FIG. 1, in which the downstream sheet is engaged by the utilization device for feeding thereinto, while a downstream portion of web directed along the upstream end of the rotator to be subsequently cut into a new upstream sheet by the cutter in accordance with the fifth feed mode.
Figure 56:
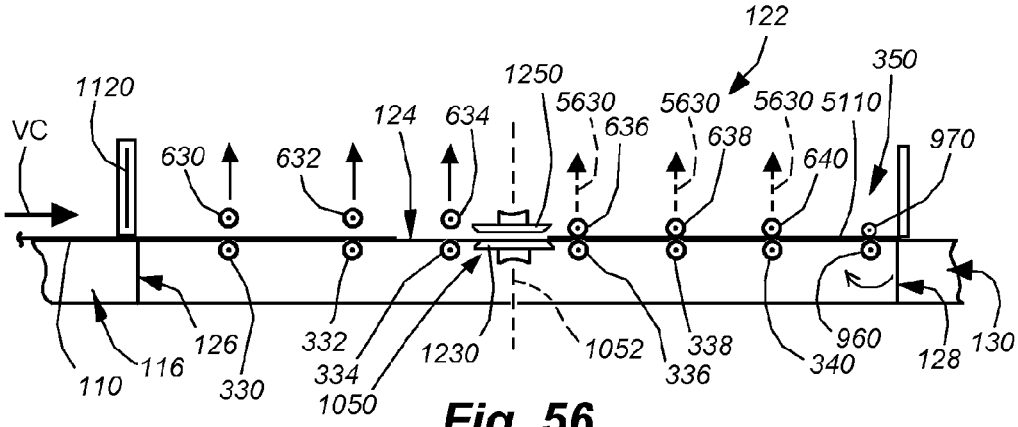
FIG. 56 is a partial side view of the arrangement of FIG. 55.

Next, as shown in FIGS. 55 and 56, the sheet 5110 has entered the outfeed roller assembly 350 for feeding to the utilization device 130. The downstream nips 636, 638 and 638 are about to be raised, as indicted by the dashed arrows 5630. The next downstream web section is being transported onto the table 124 at the cutter rate (arrow VC). The upstream nips 630, 632 and 634 have been raised to allow for the feeding of this section. The timing is such that the web section will not fully enter the table until the upstream end of the sheet 5110 has cleared its initial position, in which it will be separated from the web by the cutting blade 1120. The process continues its cycle as described above, with successive sheets separated and delivered downstream to the outfeed roller assembly 350 until all requested sheets have been fed.

It should be clear that the controller of the rotator can be programmed to provide the proper timing for engagement and disengagement of nip rollers and rotator assembly (when employed), which is proportional to the upstream/downstream length and width (if rotated) of sheets and the speed of the drive motors. The timing scheme can be implemented as a lookup table having values that increment with respect to input size increments of sheets. Alternatively, the timing can be based upon mathematical algorithms that calculate the appropriate time to engage and disengage rollers/rotator where the motor speed and sheet size are input to the algorithm and engagement/disengagement occurs at an appropriate time with respect to a controller system clock. As a further alternative, the feed table can incorporate sheet presence and/or edge sensors at appropriate locations (for example at the leading edge of each section). After a feed mode is input to the system, the engagement/disengagement of components is timed to sensing of edges. Where a lookup table is employed, the timing values can be determined empirically (carrying out appropriate calculations), or by use of experimental data after directing differing-sized sheets through the system at operational speed.

It should now also be clear that the sheet rotator described above provides a highly versatile device that serves both as an effective and high-speed feeding device for printers and other utilization devices—one that can bridge the gap between device ports at various differential elevations—and also as an efficient rotator of sheets that define a variety of sizes and dimensions. The timing of the engagement and disengagement of drive and rotation controls, and their placement, ensures continual engagement and alignment of sheets without the need of edge guides or other systems that add complexity and increase the risk of jams. Components of the rotator are also easily accessible for inspection and maintenance in accordance with the novel construction described herein.

The foregoing has been a detailed description of illustrative embodiments of the invention. Various modifications and additions can be made without departing from the spirit and scope if this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the arrangement of nip roller assemblies can be varied to handle a wider, or differing range of sheet dimensions. The number of roller pairs employed along the table can vary. Likewise the overall length of the table can vary. While roller pairs are employed, the number of rollers used on a given axis can vary, and roller triplets, for example, can be employed in alternate embodiments. The number of rollers or other drive elements linked to a single drive motor can also vary. The systems and methods by which various elements of the rotator are controlled are also highly variable. Moreover, the materials employed to construct components of the rotator are highly variable. Also, while certain elements herein are driven and others are freewheeling, the driven and freewheeling elements are interchangeable in alternate embodiments, or both opposing elements can be driven at a synchronized rate. Likewise, while a rotator "disk" is employed, this term should be taken broadly to include and type of contact surface, whether or not it defines a circle that allows for pressurable grasping and rotating of the sheet. Furthermore, while drive and nip rollers are arranged in pairs, the drive elements and actuable nips can comprise a number of rollers (or other moving elements, such as belts) arranged as a group of three or more across the width of the feed table. Alternatively, each drive element can be a single unit that has sufficient grip to prevent skewing of sheets during downstream driving—for example a widened belt assembly. As such the term "roller" as used herein to describe the driven sand nip elements should be taken broadly to include other types of moving drive members. Accordingly, this description is meant to be taken only by way of example, and not to otherwise limit the scope of this invention.

What is claimed is:

1. A system for feeding and rotating sheets transported in a downstream direction between a source of sheets and a utilization device comprising:

a feed table interconnecting the source of sheets and the utilization device, the feed table including a plurality of rotating drive elements positioned at predetermined spacing along the feed table in the downstream direction;

a plurality of actuable nip rollers that selectively engage with respective drive elements to form a respective drive nip therebetween and disengage from the drive elements to define a clearance therebetween;

a rotator disk assembly including a rotating driven disk and opposing pressure disk that selectively engages the driven disk and disengages from the driven disk to provide clearance therebetween, the driven disk and the pressure disk each being located on a common rotational axis perpendicular to a plane of the feed table and the rotator disk assembly being located on the feed table between a plurality of the sets of drive elements upstream and a plurality of the sets of drive elements downstream of the driven disk;

further comprising a controller that selectively disengages predetermined nip rollers adjacent to sheets to provide clearance for sheets as sheets are driven at a differential speed with respect to a drive speed provided by the plurality of rotating drive elements and engages the predetermined nip rollers adjacent to sheets when sheets are to be maintained in alignment on the feed table and driven along the feed table at the drive speed provided by the drive elements;

wherein the controller selectively disengages at least some of the predetermined nip rollers adjacent to the rotator disk assembly to provide clearance for each of the sheets as the sheets are engaged by the pressure disk and rotated by the driven disk;

wherein the controller selectively engages at least some of the predetermined nip rollers adjacent to the rotator disk assembly and disengages the pressure disk to provide a clearance after each of the sheets is rotated by the driven disk so as to transport each of the sheets downstream; and wherein the controller selectively disengages at least some of the predetermined nip rollers adjacent to an upstream end of the feed table when each of the sheets enters the feed table from the source at a source feed rate and engages at least some of the predetermined nip rollers adjacent to the upstream end when each of the sheets is stopped by the source on the upstream end to thereby engage and drive each of the sheets.

2. A system for feeding and rotating sheets transported in a downstream direction between a source of sheets and a utilization device comprising:

a feed table interconnecting the source of sheets and the utilization device, the feed table including a plurality of rotating drive elements positioned at predetermined spacing along the feed table in the downstream direction;

a plurality of actuable nip rollers that selectively engage with respective drive elements to form a respective drive nip therebetween and disengage from the drive elements to define a clearance therebetween;

a rotator disk assembly including a rotating driven disk and opposing pressure disk that selectively engages the driven disk and disengages from the driven disk to provide clearance therebetween, the driven disk and the pressure disk each being located on a common rotational axis perpendicular to a plane of the feed table and the rotator disk assembly being located on the feed table between a plurality of drive elements upstream and a plurality of drive elements downstream of the driven disk;

a base support for the pressure disk;

wherein the pressure disk comprises an axially moving upper housing and a pressure plate, the upper housing and pressure plate being together that is freely rotatable with respect to the base support and movable laterally within a predetermined range with respect to the base support so as to align an axis of rotation of the pressure disk and an axis of rotation of the driven disk with the common rotational axis.

3. The system as set forth in claim 2 including a main shaft supported for sliding relative to the base support, the upper housing constructed and arranged to provide a clearance gap between the upper housing and the main shaft to allow the upper housing to move laterally with respect to the main shaft.

4. A system for feeding and rotating sheets transported in a downstream direction between a source of sheets and a utilization device comprising:

a feed table interconnecting the source of sheets and the utilization device, the feed table including a plurality of rotating drive elements positioned at predetermined spacing along the feed table in the downstream direction;

a plurality of actuable nip rollers that selectively engage with respective drive elements to form a respective drive nip therebetween and disengage from the drive elements to define a clearance therebetween;

a rotator disk assembly including a rotating driven disk and opposing pressure disk that selectively engages the driven disk and disengages from the driven disk to provide clearance therebetween, the driven disk and the pressure disk each being located on a common rotational axis perpendicular to a plane of the feed table and the rotator disk assembly being located on the feed table between a plurality of drive elements upstream and a plurality of drive elements downstream of the driven disk;

wherein the pressure disk is normally biased into an upward, retracted position by a biasing spring, and is movable axially within a base support against the spring bias, downwardly toward the driven disk under action of a solenoid assembly;

a main shaft and bearing assembly that enable the main shaft to slide with respect to the base support, the pressure disk including a disk shaped end piece that is nested within a bell-shaped upper housing having a flat top surface and a chamfered top perimeter edge, the top surface providing a clearance with respect to the main shaft, the clearance allowing the upper housing to move laterally with respect to the shaft and corresponding common axis.

5. A system for feeding and rotating sheets transported in a downstream direction between a source of sheets and a utilization device comprising:

a feed table interconnecting the source of sheets and the utilization device, the feed table including a plurality of rotating drive elements positioned at predetermined spacing along the feed table in the downstream direction;

a plurality of actuable nip rollers that selectively engage with respective drive elements to form a respective drive nip therebetween and disengage from the drive elements to define a clearance therebetween;

a rotator disk assembly including a rotating driven disk and opposing pressure disk that selectively engages the driven disk and disengages from the driven disk to provide clearance therebetween, the driven disk and the pressure disk each being located on a common rotational axis perpendicular to a plane of the feed table and the rotator disk assembly being located on the feed table between a plurality of drive elements upstream and a plurality of drive elements downstream of the driven disk;

wherein the pressure disk is normally biased into an upward, retracted position by a biasing spring, and is movable axially within a base support against the spring bias, downwardly toward the driven disk under action of a solenoid assembly;

a bearing assembly and an inner face plate, the bearing assembly being positioned between the inner face plate and the bottom face of the pressure disk, the plate have a limited range of is freely rotatable with respect to the common axis, being constructed and arranged to rotate with a predetermined range of eccentricity with respect to the common axis so that the sheet is substantially free of slippage with respect to the pressure disk during rotation in response to a minor misalignment between the sheet and the rotator disk assembly.

6. A system for feeding and rotating sheets transported in a downstream direction between a source of sheets and a utilization device comprising:

a feed table interconnecting the source of sheets and the utilization device, the feed table including a plurality of rotating drive elements positioned at predetermined spacing along the feed table;

a plurality of actuable nip rollers that selectively engage with respective drive elements;

a rotator disk assembly including a rotating driven disk and opposing pressure disk that selectively engages the driven disk and disengages from the driven disk to provide clearance therebetween, the driven disk and the pressure disk each being located on a common rotational axis perpendicular to a plane of the feed table and the rotator disk assembly being located on the feed table between a plurality of the sets of drive elements upstream and a plurality of the sets of drive elements downstream of the driven disk;

a base support for the pressure disk;

wherein the pressure disk comprises an axially moving upper housing and a pressure plate, the upper housing and pressure plate together freely rotatable with respect to the base support and movable laterally within a predetermined range with respect to the base support so as to align an axis of rotation of the pressure disk and an axis of rotation of the driven disk with the common axis of rotation.

7. The system as set forth in claim 6 wherein the pressure disk is normally biased into an upward, retracted position, and is movable axially downwardly toward the driven disk.

8. The system as set forth in claim 7 further comprising a main shaft and a bearing assembly that enable the main shaft to slide axially with respect to the base support, the pressure disk including a disk-shaped end piece having a flat top surface bearing against the upper housing providing a clearance with respect to the main shaft, the clearance allowing the upper housing to move laterally with respect to the shaft and the common axis.

9. The system as set forth in claim 7 further comprising a bearing assembly and an inner face plate, the bearing assembly being positioned between the inner face plate and the pressure disk and being constructed and arranged to rotate with a predetermined range of eccentricity with respect to the common axis so that the sheet is substantially free of slippage with respect to the pressure disk during rotation in response to a minor misalignment between the sheet and the rotator disk assembly.

* * * * *